United States Patent [19]

Hoffmann

[11] 4,242,167

[45] Dec. 30, 1980

[54] LABELING MACHINE

[75] Inventor: Wolfgang Hoffmann, Modesto, Calif.

[73] Assignee: B & H Manufacturing Company, Inc., Ceres, Calif.

[21] Appl. No.: 954,865

[22] Filed: Oct. 26, 1978

[51] Int. Cl.[3] ..... B65C 9/04

[52] U.S. Cl. ..... 156/357; 118/261; 156/361; 156/449; 156/456; 156/521; 226/35; 226/45; 226/115

[58] Field of Search ..... 156/353–355, 156/351, 356–357, 518–521, 361, 566–568, 456; 226/35, 115, 117, 4, 118; 118/261, 262, 258, 259; 83/280, 282, 209, 210

[56] References Cited

U.S. PATENT DOCUMENTS

| | | | |
|---|---|---|---|
| 2,573,336 | 10/1951 | Holmwood | 118/261 |
| 2,735,677 | 2/1956 | Sandvik et al. | 226/35 |
| 2,936,921 | 5/1960 | Schulz | 156/357 X |
| 2,989,940 | 6/1961 | Williams | 118/262 X |
| 3,177,749 | 4/1965 | Best et al. | 226/118 X |
| 3,379,171 | 4/1968 | Condingly et al. | 18/261 |
| 3,512,438 | 5/1970 | Burdge | 226/115 X |
| 3,522,134 | 7/1970 | Von Hofe et al. | 156/357 X |
| 3,783,058 | 1/1974 | Solomon et al. | 156/355 X |
| 3,864,184 | 2/1975 | Carter | 156/364 |
| 4,029,537 | 6/1977 | Kish | 156/521 |

*Primary Examiner*—David A. Simmons
*Attorney, Agent, or Firm*—Edward B. Gregg

[57] ABSTRACT

Labeling machine in which continuous label stock is pulled from a roll of same by a continuously operating drive roller and a pinch roller which is alternately engaged with and disengaged from the drive roller; means for storing a supply of label stock in the form of a loop; reciprocating label feed withdrawing label stock from the loop and feeding it forwardly one label at a time; means for severing a label during each cycle of operation; a vacuum feed drum for receiving labels from the severing means and having pivoted pads which can be pivoted out of contact with a glue wheel when there is no label on the pad; means for applying glue to each label on a pad; means for then applying each label to a container.

22 Claims, 23 Drawing Figures

FIG-8
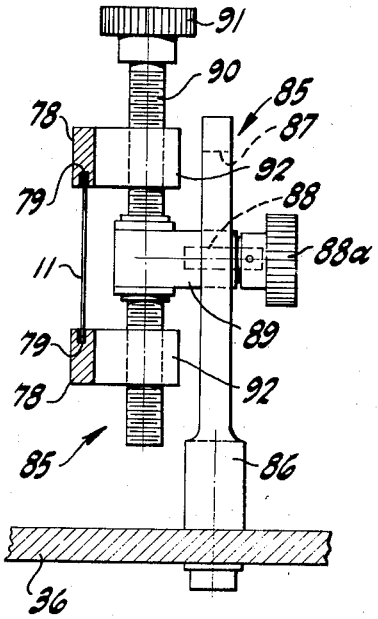
FIG-9
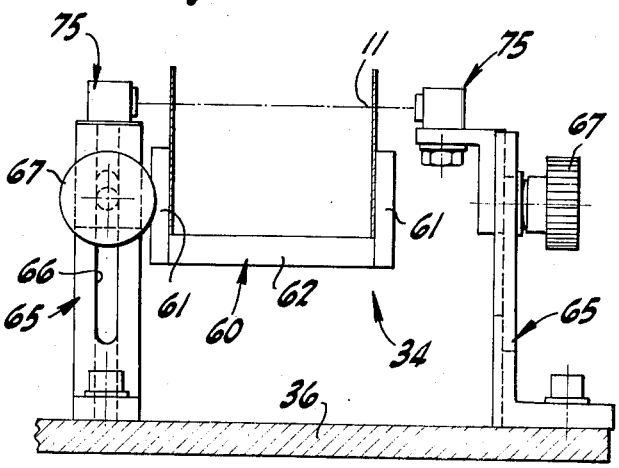
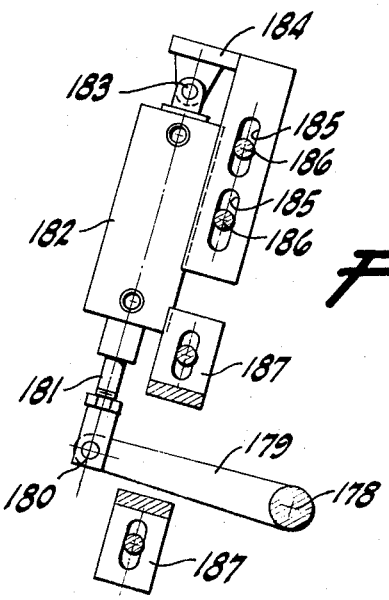
FIG-7

420
200
202
245
314
201
~11~
~12~
243
241
272
209
410
242
267
270
271
273
214
240
247
246
~13~
310
311
313
304
303
302
301
300
172
78
11
170
173
190
174
175
215
216
212
208

FIG. 15
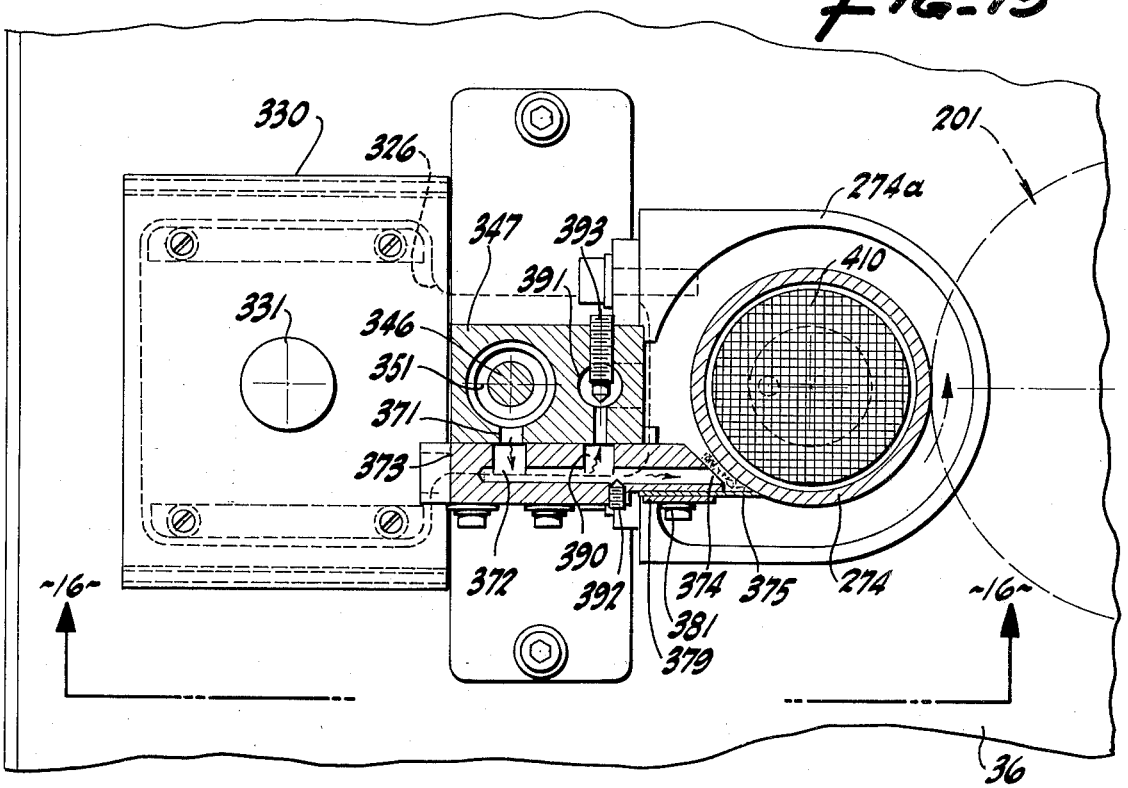
FIG. 16
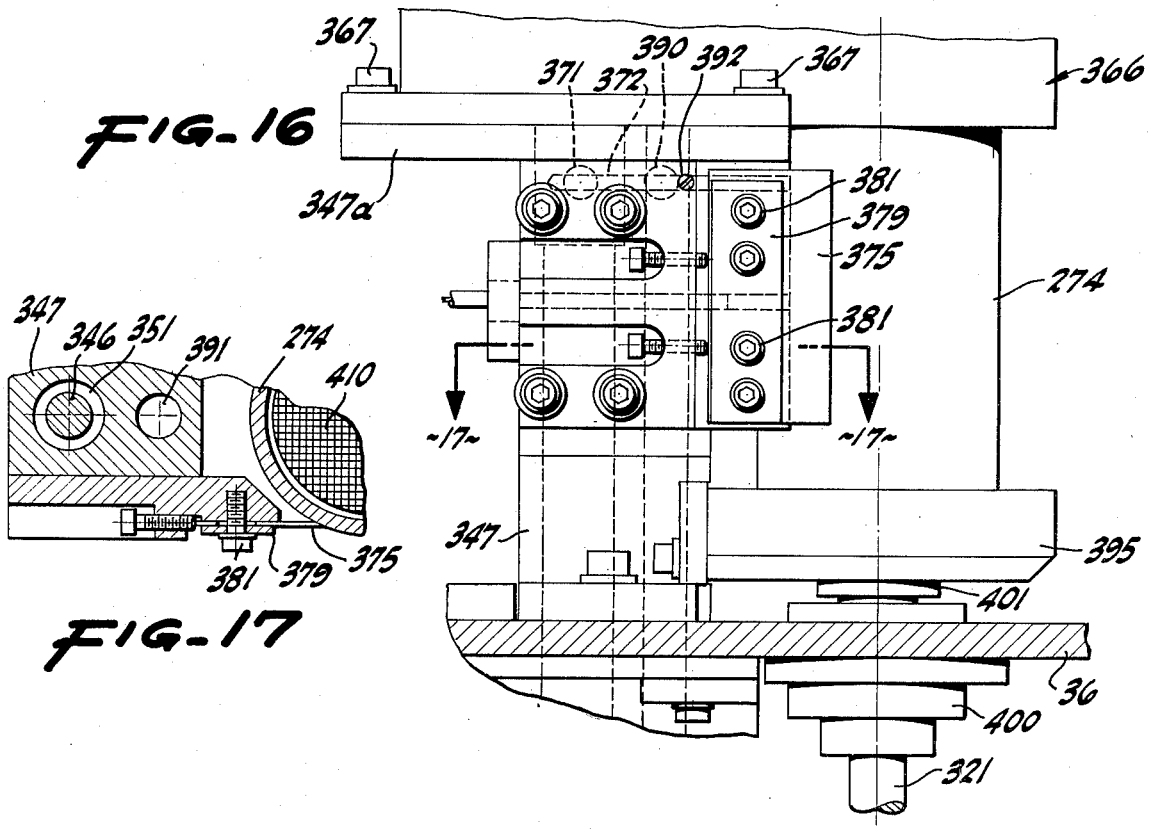
FIG. 17

LABELING MACHINE

This invention relates to a labeling machine for applying labels to containers, such containers being glass containers, metal containers of plastic containers. The containers may be relatively large containers such as those in which food is canned or they may be small containers such as those in which pharmaceuticals are packaged. It will become apparent that the apparatus may be used to apply labels to articles generally, e.g. to packages, work pieces such as metal or plastic blanks, etc. The term "labels" is intended to include not only labels in the ordinary sense but also other sheet or film material such as paper, plastic, metal, foil or textile material supplied in the form of a continuous sheet or web and severed into smaller pieces which are then applied to articles such as containers, packages, etc.

In the art of labeling machines, typified, for example, by my U.S. Pat. Nos. 3,765,991 and 3,834,963, in certain environments it is desirable to operate at high speed, for example, to apply labels to containers at the rate of 500 per minute. For example, in a cannery where high production rates prevail, it is desirable that high speed labeling machinery capable of such speeds be employed. For such purposes, relatively expensive machines are justified. Typically such machines include a glue assembly for applying glue to the labels which is a separate purchased item adding to expense and to installation charges. Such added expense is justified for certain uses. Typically in such high speed, relatively expensive machines preprinted label stock is employed and is supplied in the form of rolls; the label stock is pulled continuously from the rolls, suitable tensioning means being employed to maintain adequate tension on the continuous label stock; the label stock is severed by continuously operating cutting means; each severed label, either just before or just after it has been severed, is fed to a rotating vacuum label feed drum and is held on the periphery of the drum by vacuum; each label passes a glue station where a glue wheel applies glue to the outer, exposed surface of the label (which becomes the inner concealed surface after the label has been applied to the container), such glue wheel being reciprocated into and out of engagement with the label according to signals received. For example, if there is a signal indicating that a label is missing or that a container is missing, the glue wheel is moved out of position. The labels with glue applied to their exposed surfaces are then applied to containers at a labeling station. Various container feeds may be used for this purpose.

There is a considerable market and need for labeling machinery which will accomplish these functions but which, at an acceptable sacrifice of speed (for example, operating at about 100 labels per minute) is lower in cost.

It is an object of the present invention to provide improvements in labeling machinery.

It is a further object of the invention to provide a labeling machine capable of operating at speeds of approximately 100 labels per minute, which is lower in cost than high speed machines of the type referred to above.

It is a still further object of the invention to provide a low cost, moderate speed labeling machine which embodies one or more advantages such as avoidance of the need for the label feed to the cutter and label drum to pull the web of label stock directly off of its roll; employment of a label vacuum drum which does not require withdrawal of the glue wheel to avoid contact of the glue wheel with the label drum when there is no label or container is present, and a simpler, less expensive glue assembly.

The above and other objects of the invention will be apparent from the ensuing description and the appended claims.

One embodiment of the invention is illustrated by way of example in the accompanying drawings, in which:

FIG. 3 is a continuation of FIG. 2;

Figure 2:
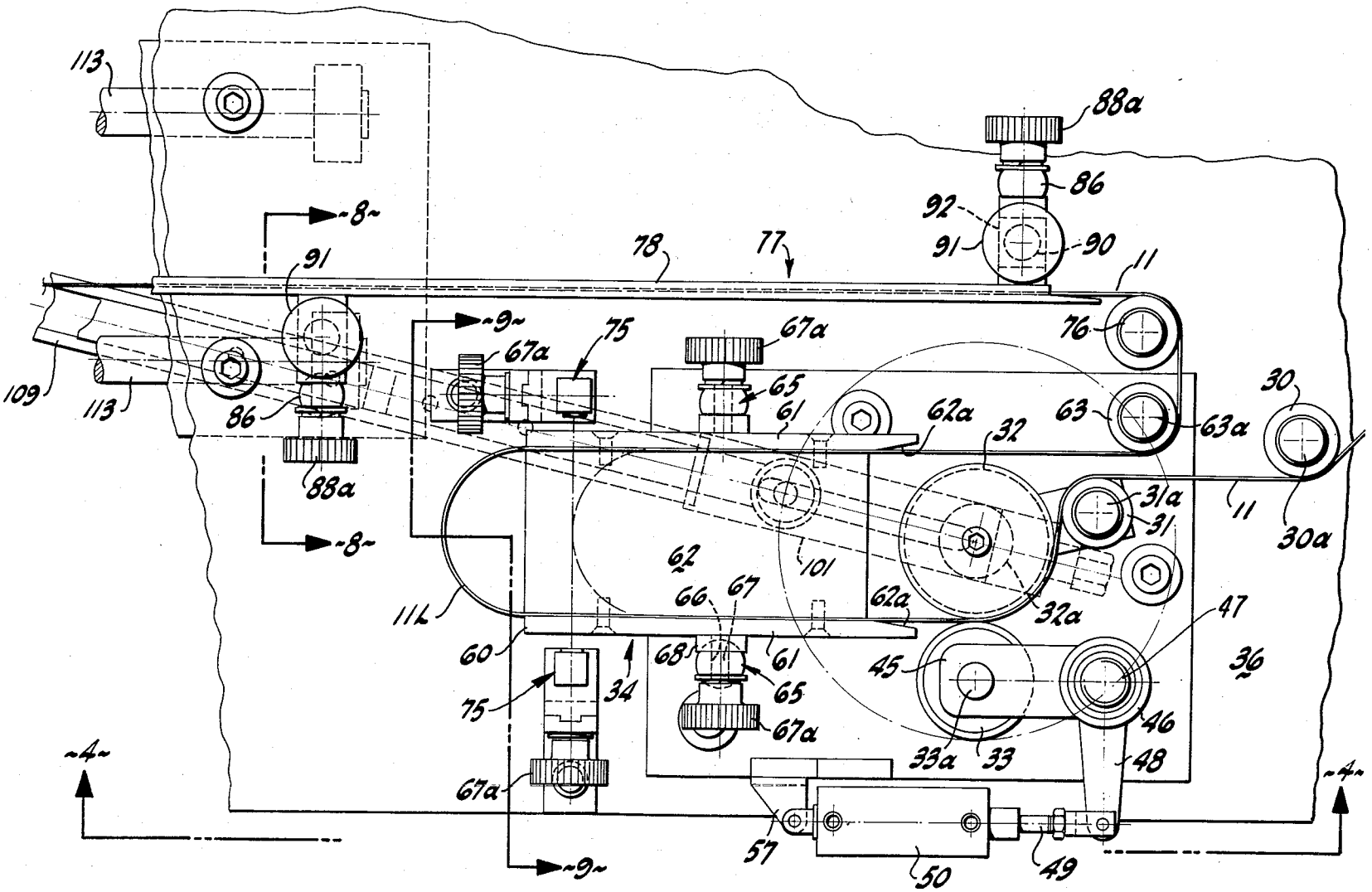
FIG. 2 is a top plan view of that portion of the apparatus including the drive for the label stock, the loop forming station for storage of label stock and part of the reciprocating intermittent feed for the label stock.
Figure 3:
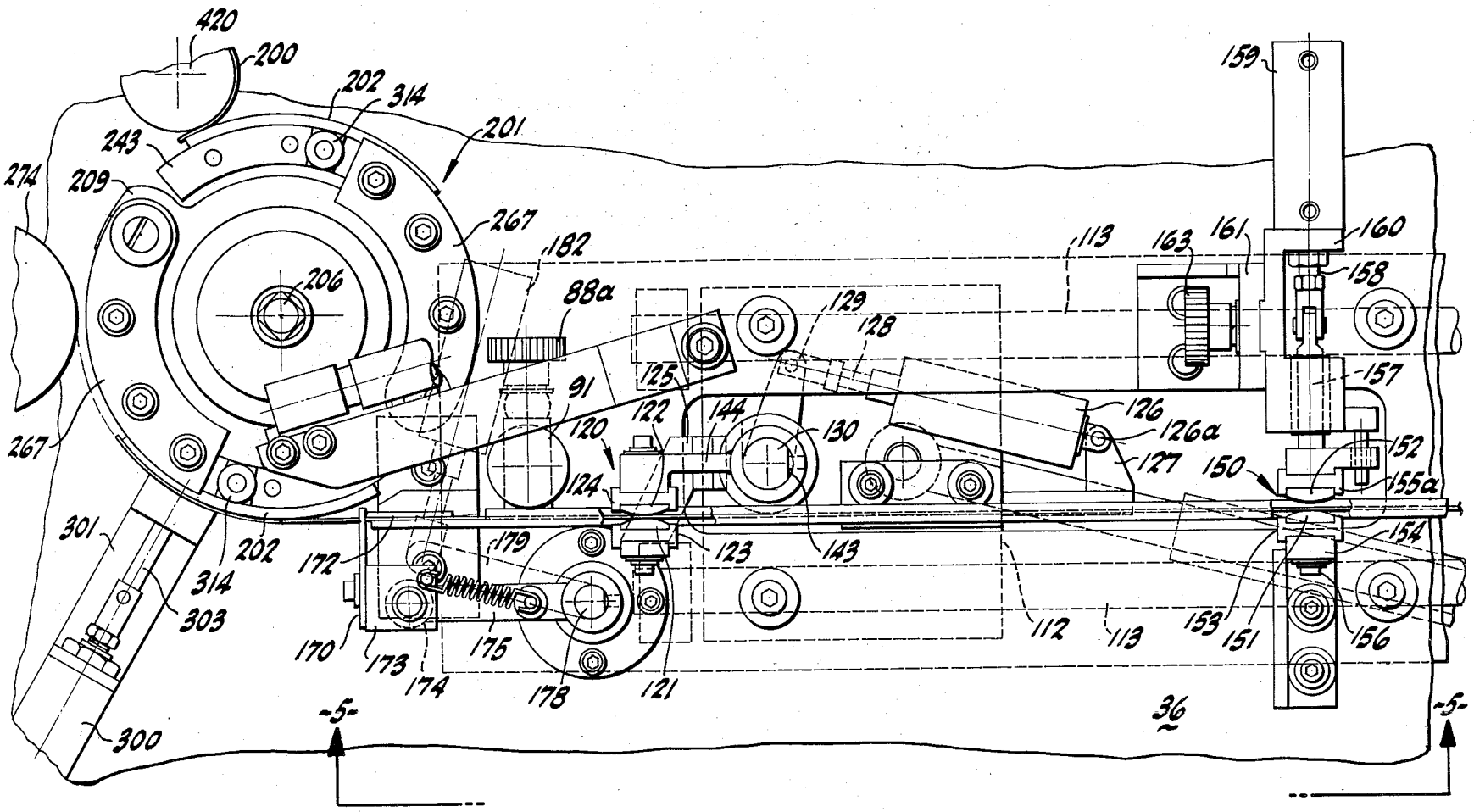
FIG. 3 is a similar view downstream from that of FIG. 2 and shows the means for intermittently feeding the label stock forwardly from the storage loop one label at a time, and it also shows the shearing means for severing labels from the label stock and the vacuum drum to which labels are applied as they are sheared.
Figure 4:
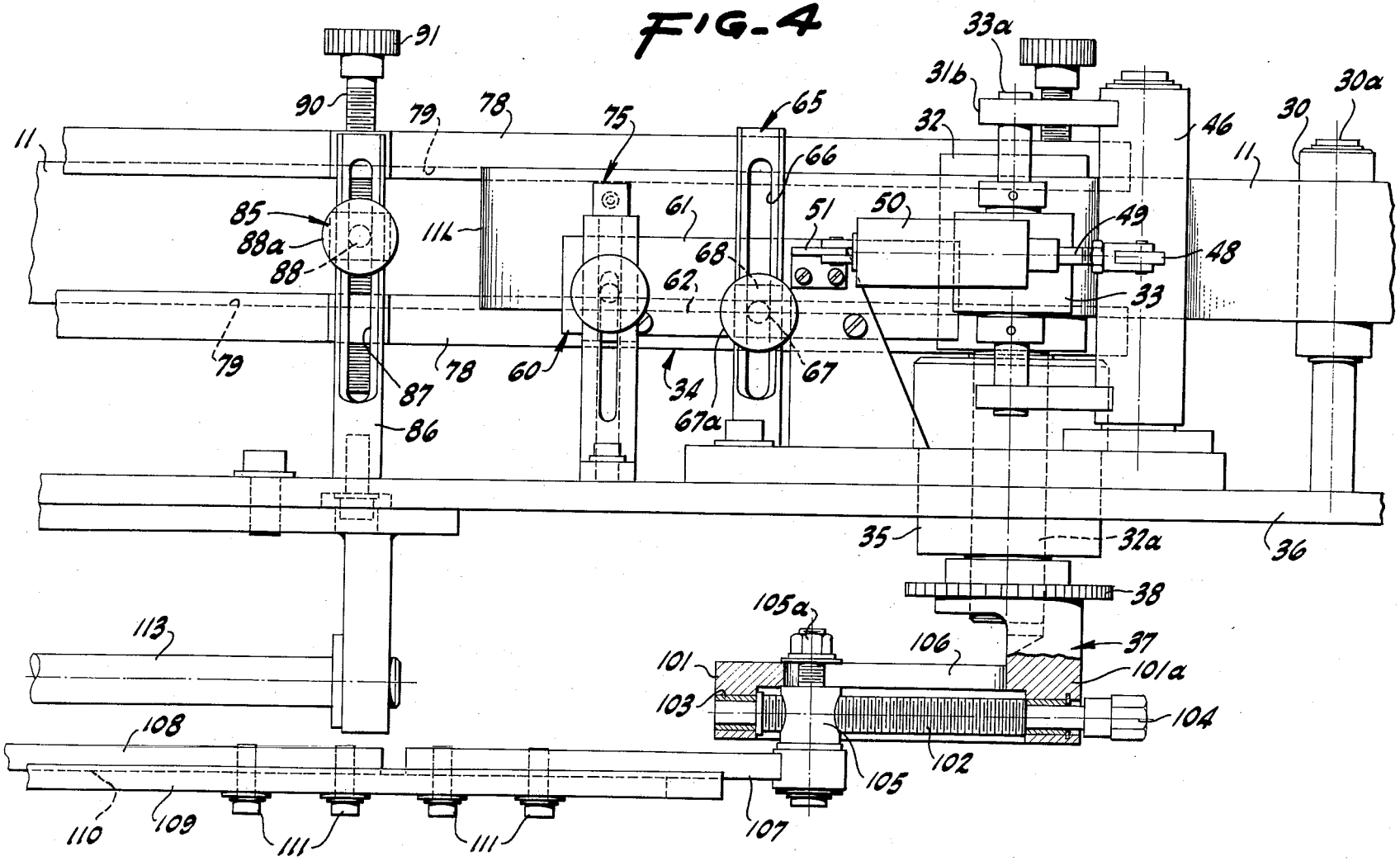
Figure 5:
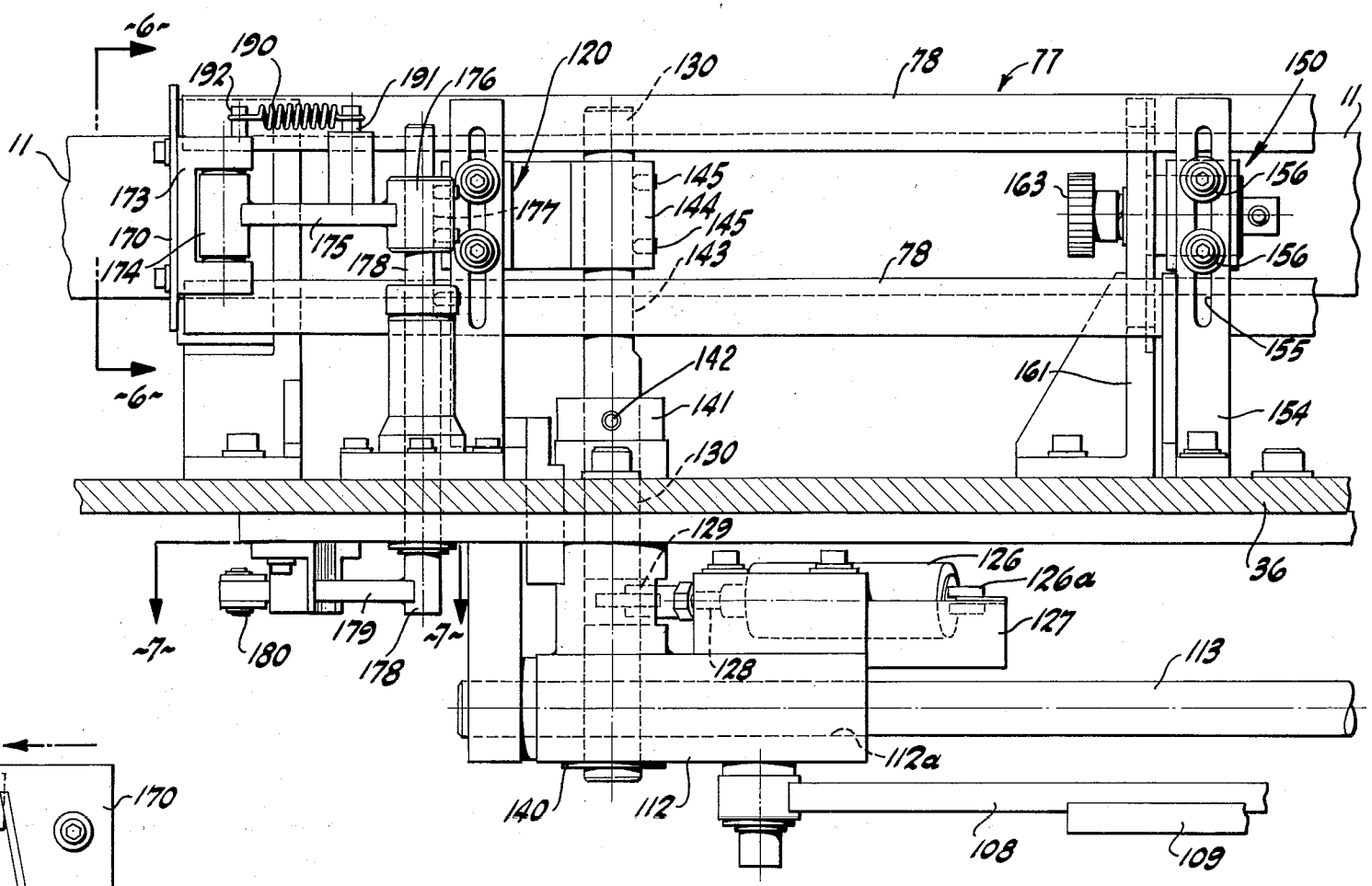
Figure 6:
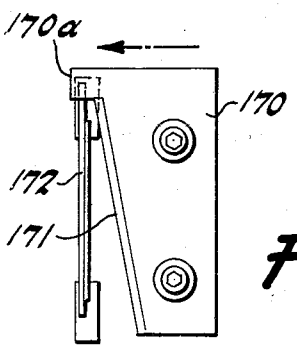
Figures 10, 13:
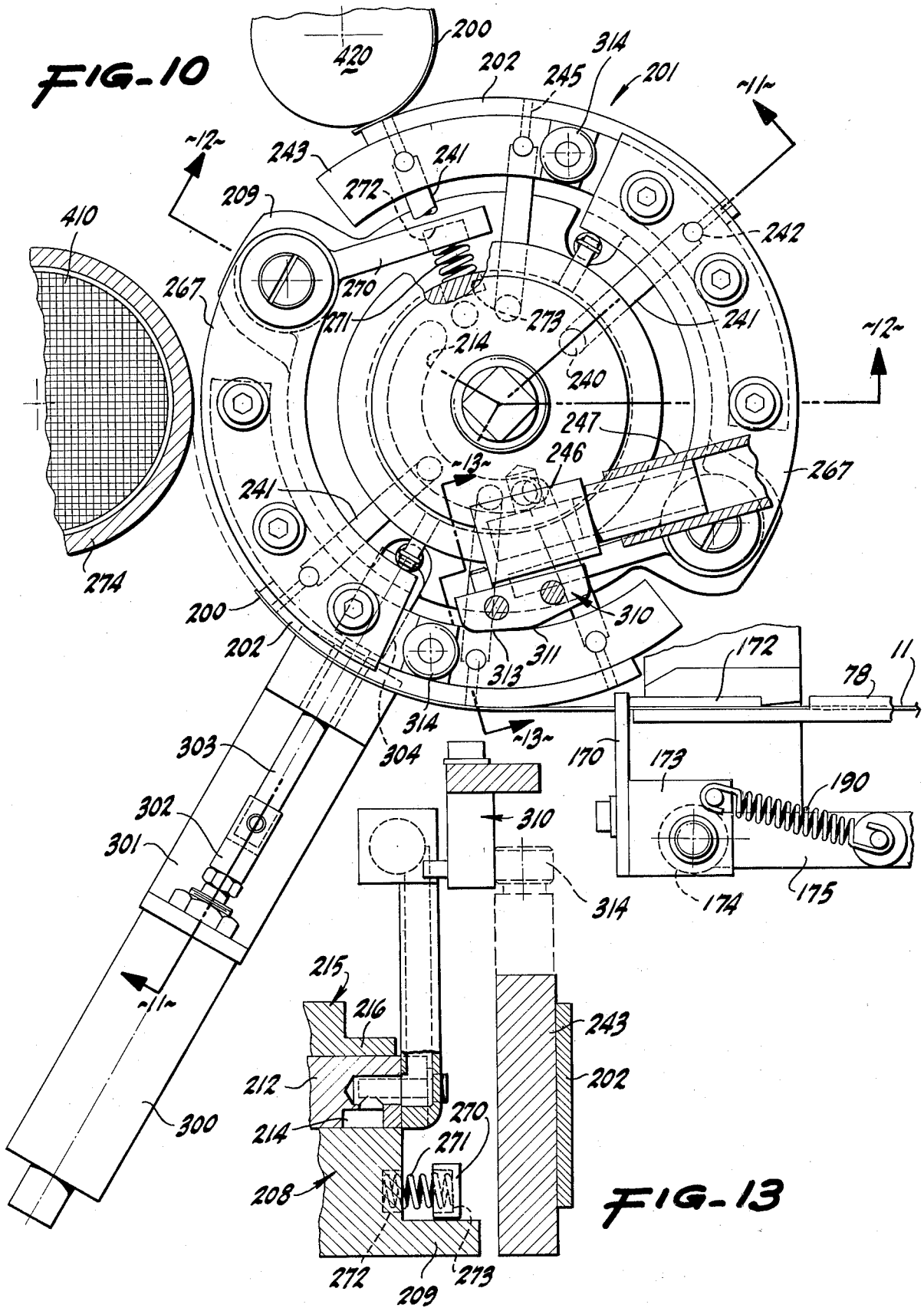
Figure 11:
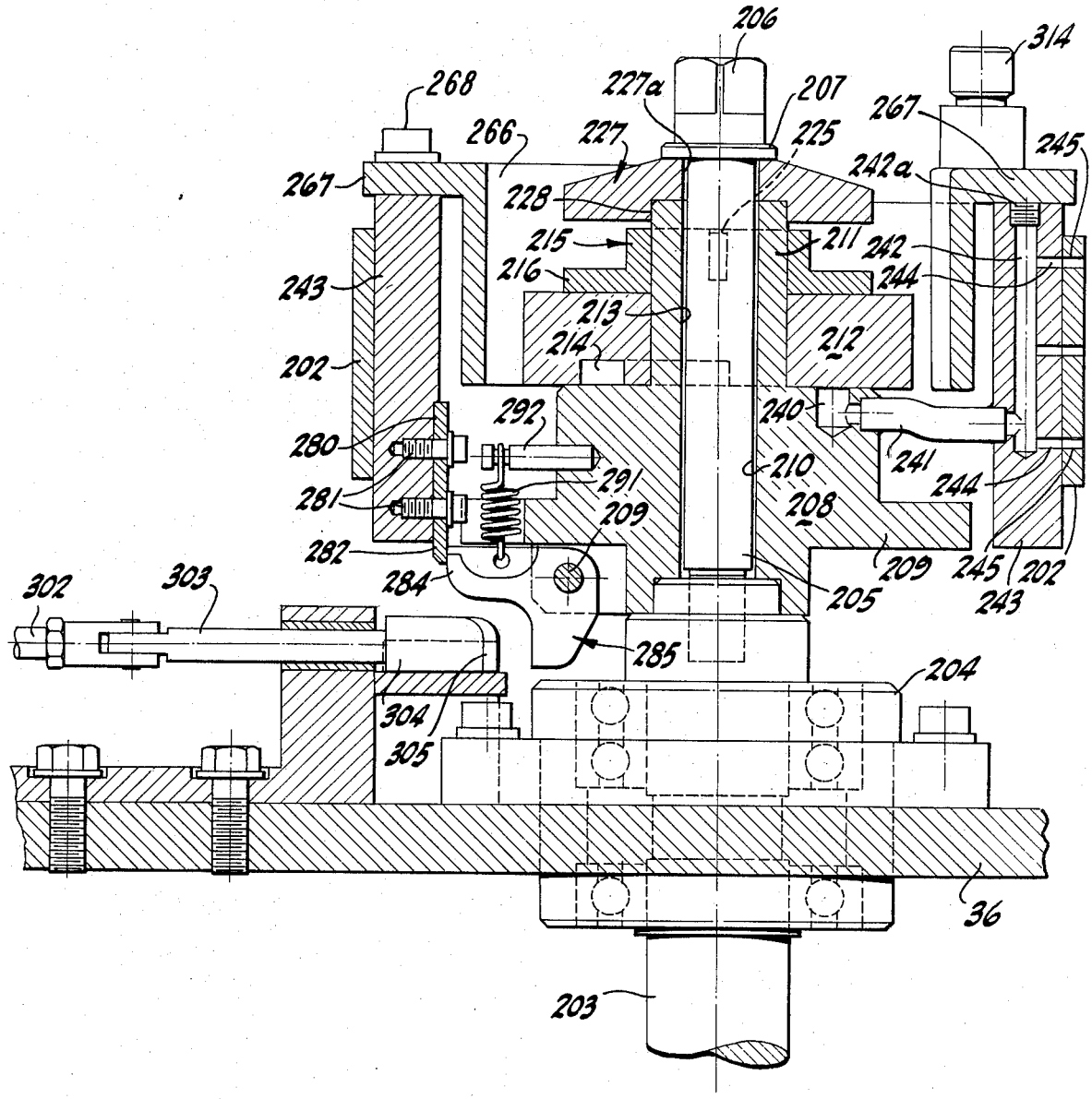
Figure 12:
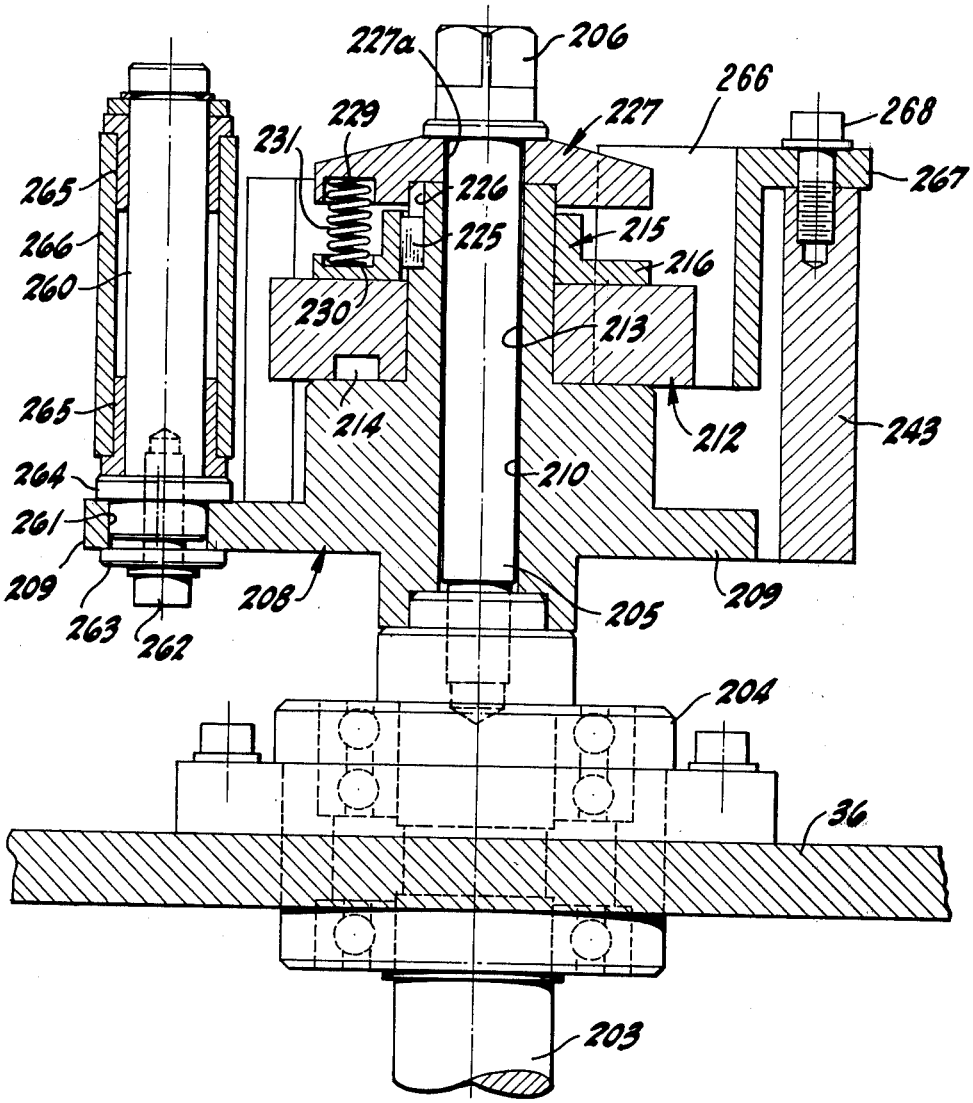
Figure 14:
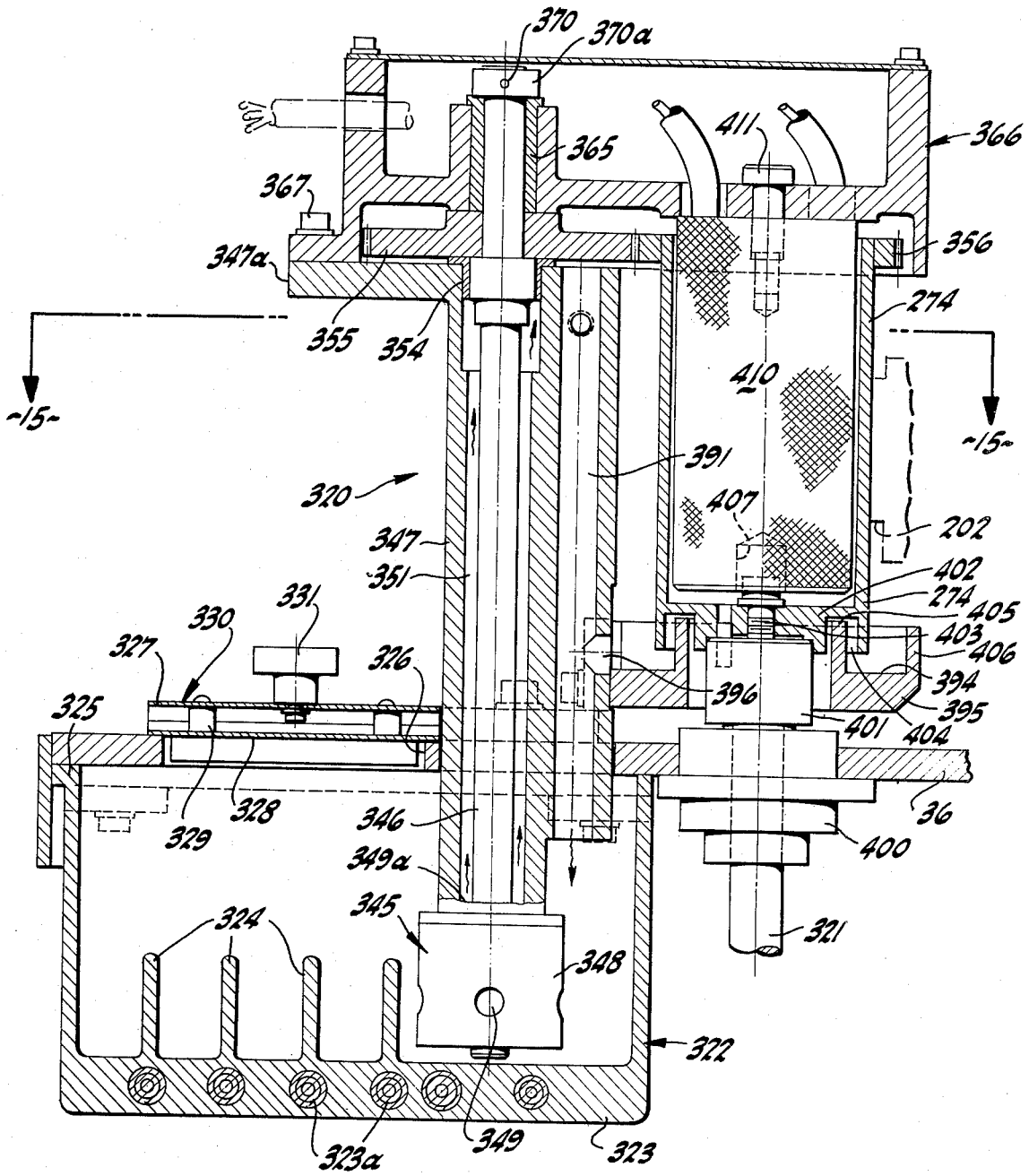
Figure 18:
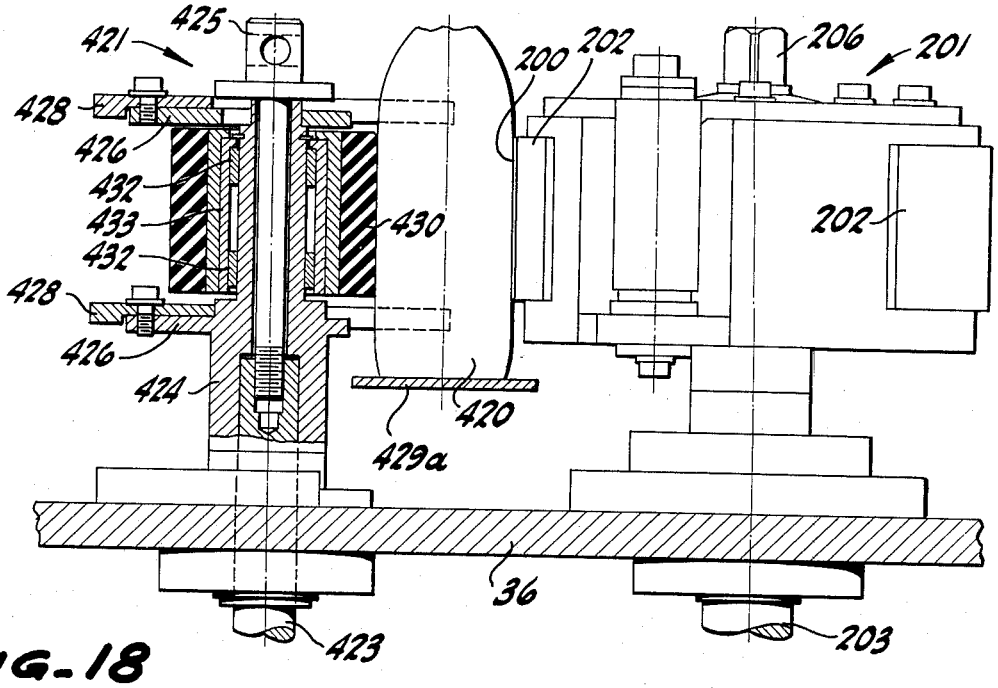
Figure 19:
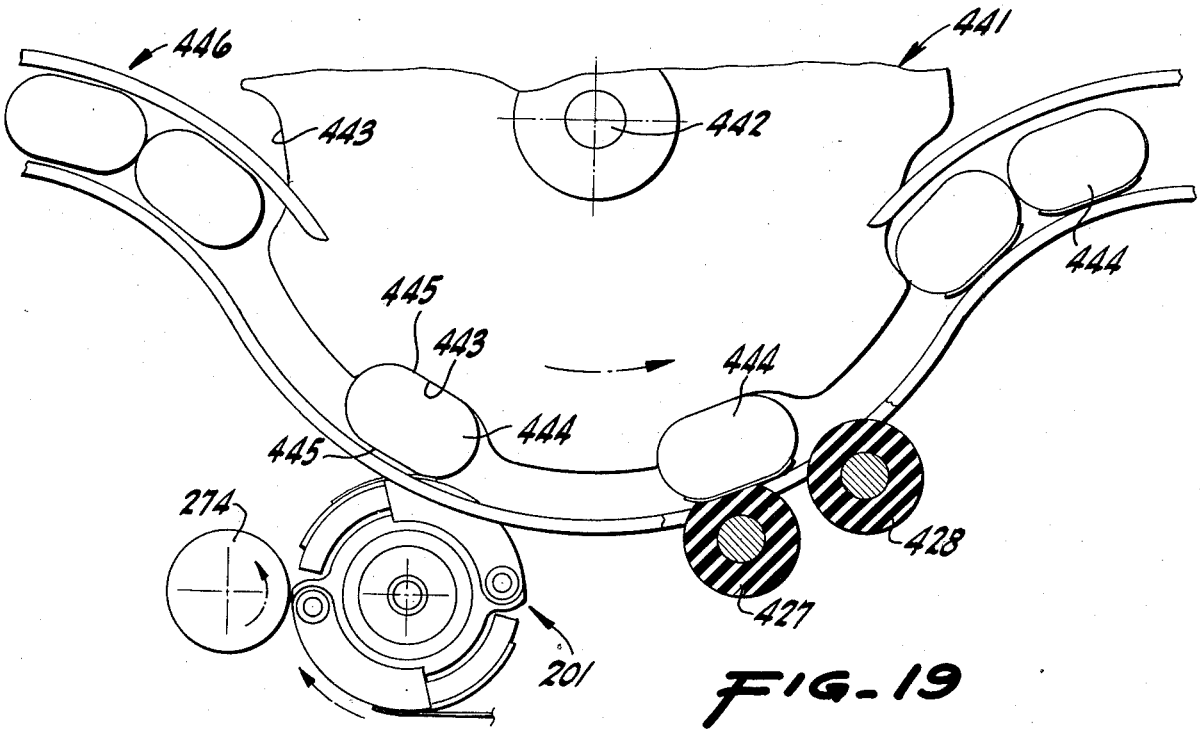
Figure 20:
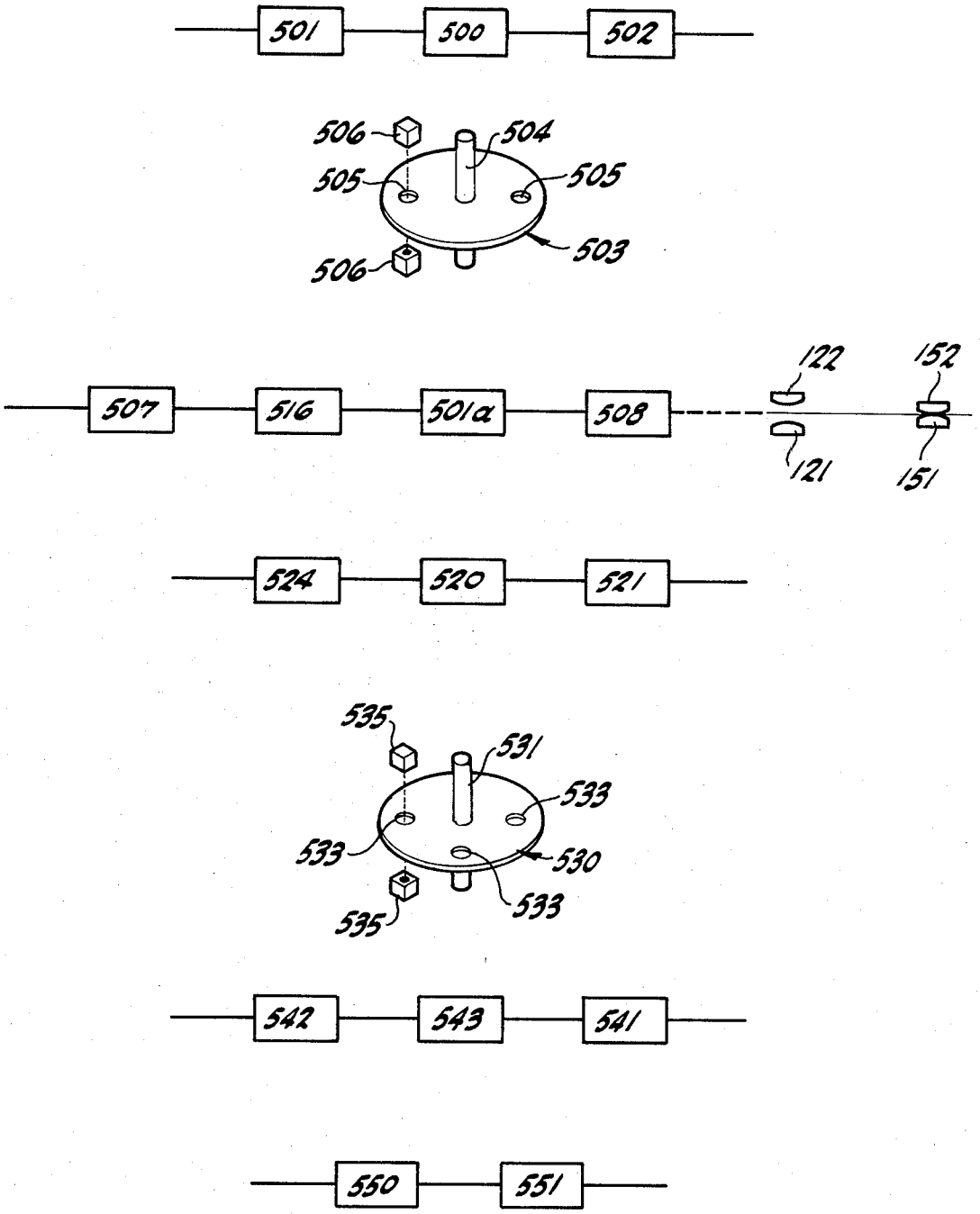
Figure 21:
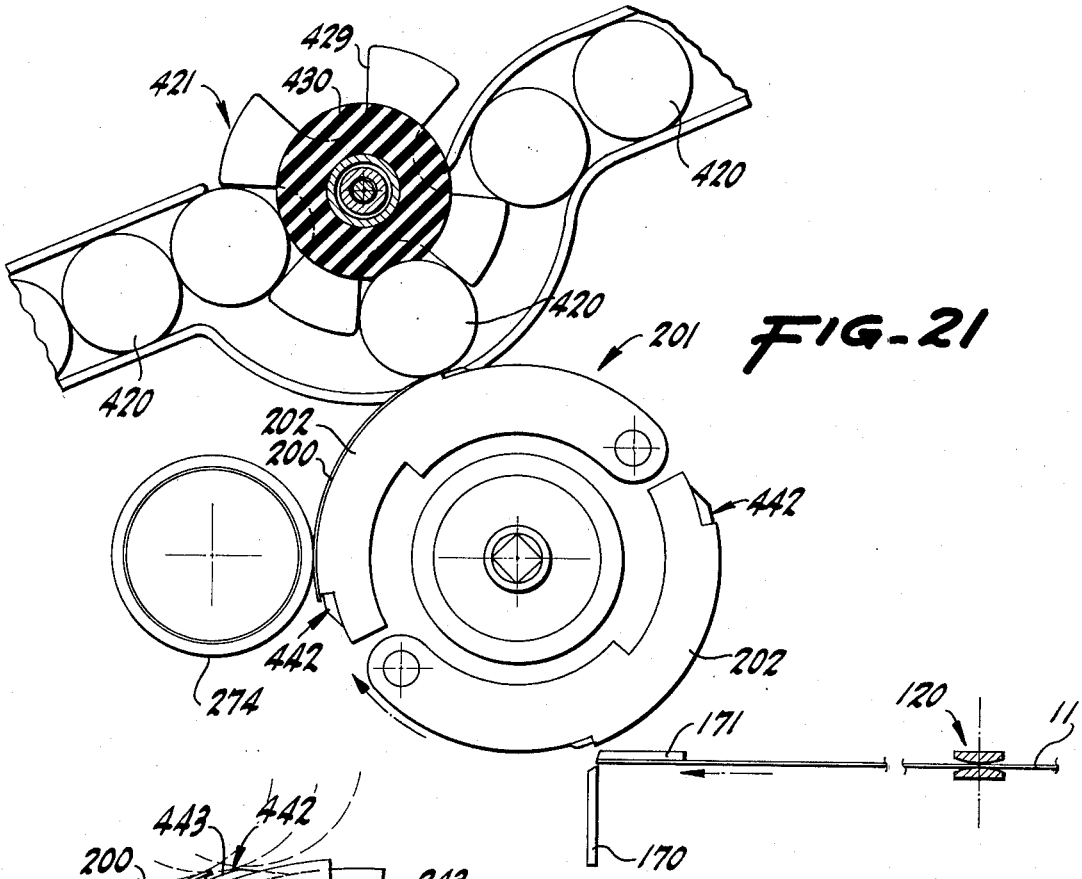
Figure 22:
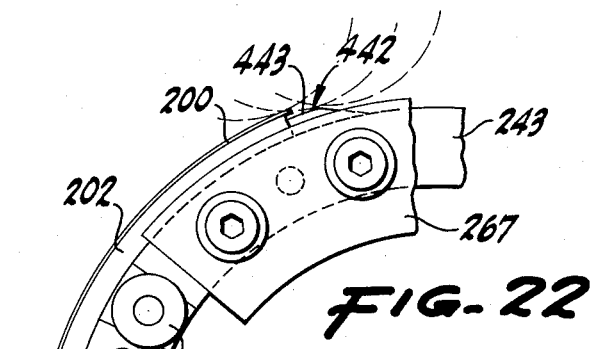
Figure 23:
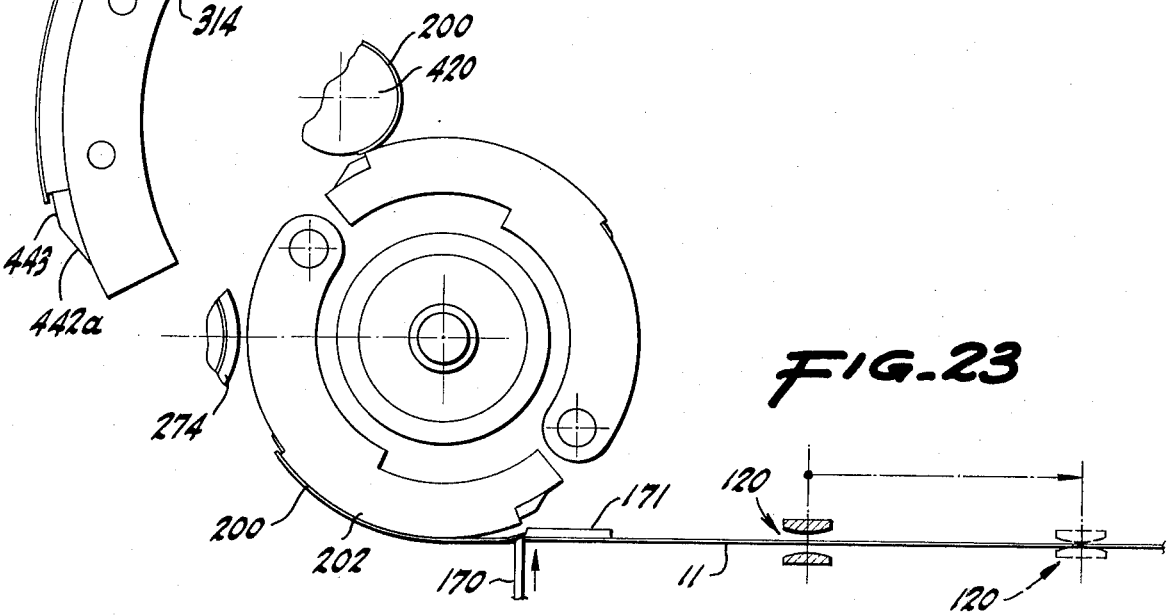

FIGS. 4 and 5 are, respectively, side elevations as seen along the lines 4—4 and 5—5, respectively, of FIGS. 2 and 3;

FIG. 6 is a view in front elevation of the shearing means for severing labels from the label stock, such being shown detached from the rest of the apparatus;

FIG. 7 is a view taken along the line 7—7 of FIG. 5 showing the means for operating the shaft that in turn operates the shear;

FIG. 8 is a view taken along the line 8—8 of FIG. 2;

FIG. 9 is a staggered section taken along the line 9—9 of FIG. 2;

FIG. 10 is a view of the vacuum label feed similar to that in FIG. 3 but on a larger scale;

FIG. 11 is a section taken along the line 11—11 of FIG. 10;

FIG. 12 is a section taken along the line 12—12 of FIG. 10;

FIG. 13 is a section taken along the line 13—13 of FIG. 10;

FIG. 14 is a vertical mid-section through the glue assembly which supplies glue to and applies it to the glue wheel;

FIG. 15 is a view taken along the line 15—15 of FIG. 14;

FIG. 16 is a view taken along the line 16—16 of FIG. 15;

FIG. 17 is a fragmentary view taken along the line 17—17 of FIG. 16;

FIG. 18 is a view in side elevation of the vacuum label drum showing a container feed in the vertical mid-section;

FIG. 19 is a top plan view of another type of container feed as shown in cooperative relation to the vacuum label drum;

FIG. 20 is a partial, diagrammatic control circuit;

FIG. 21 is a view in top plan of the label drum and star wheel showing a modification of the pads on the label drum;

FIG. 22 is a fragmentary section taken through the label drum, being a section along the diameter of the drum; and FIG. 23 is a top plan view of the label drum and shear.

Figure 1:
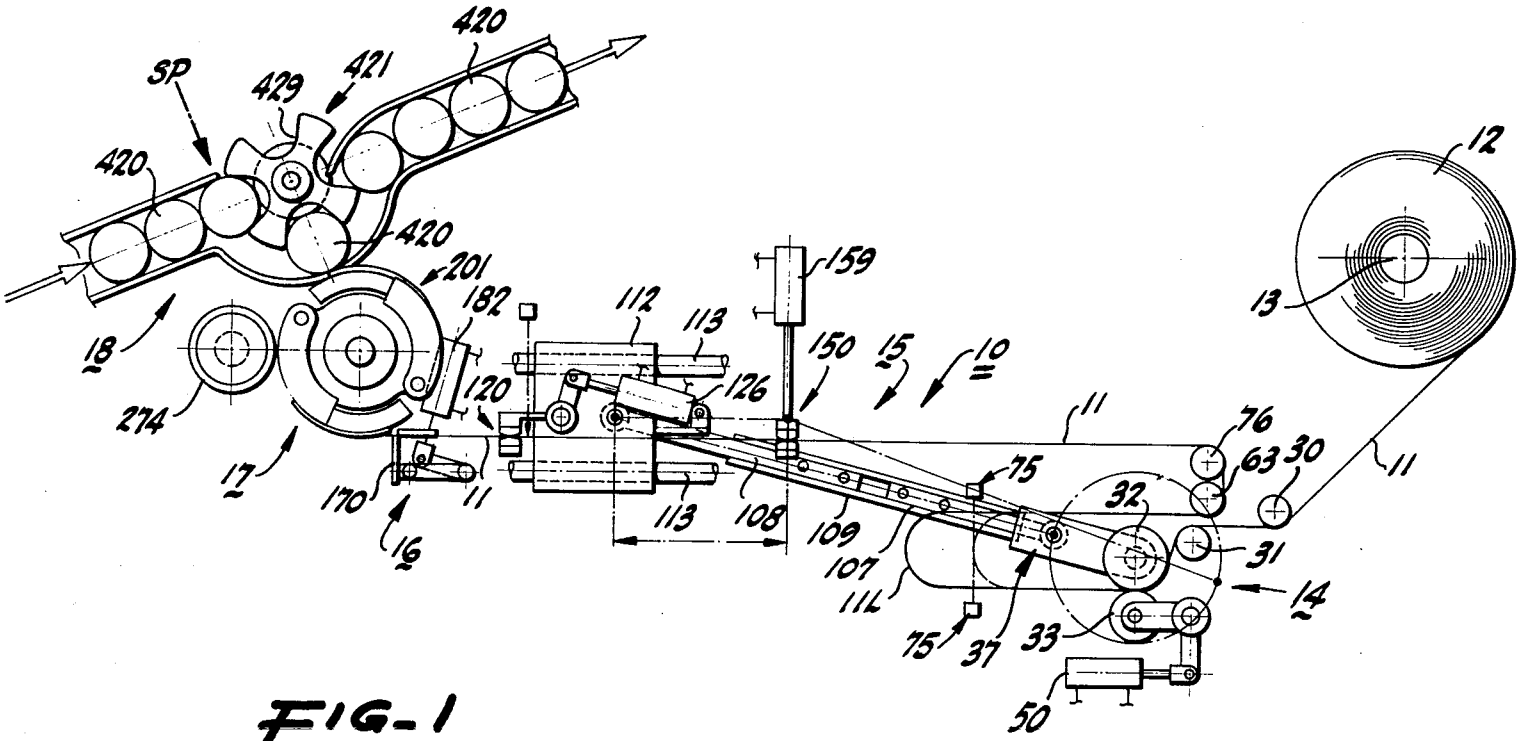
FIG. 1 is a somewhat diagrammatic overall view of the apparatus.

Referring to FIG. 1, the apparatus is generally designated as 10, the label stock or web as 11 and the roll from which the label stock is taken as 12. As stated above, the web 11 may be any continuous sheet, strip or film material preprinted or otherwise. Hereinafter in the detailed description "labels" and "label stock" will be referred to. The reel 12 rotates on an axle 13. Station 14 is a label pre-feed and storage which serves to pull a pre-determined length of label stock from the reel and store it in the form of a loop as hereinafter described. A reciprocating label feed is provided which is designated as 15 and serves to feed intermittently a single label length to a label shearing station as 16. A rotary vacuum label feed drum 17 receives the labels from the severing station 16 and applies them to containers at a label applying station 18.

Referring to FIGS. 2 and 4, the label stock 11 is supplied over a guide roller 30 on a shaft 30*a*, then over a guide roller 31 on a shaft 31*a*, then between drive roller 32 on shaft 32*a* and a pinch roller 33 on a shaft 33*a*. The rollers 32 and 33 are parallel. The drive roller 32 is driven continuously from the main drive of the machine (not shown) which also serves to drive certain other parts of the machine as described hereinafter. Therefore the drive roller 32 operates and supplies label stock at a speed proportioned to that of the machine as a whole. The label stock is fed by rollers 32 and 33 to loop accumulator 34 which functions as described hereinafter. Shaft 31*a* is carried on a bracket 31*b*. Shaft 32*a* (see FIG. 4) is carried by bearing 35 which is mounted in a frame plate 36. The shaft 32*a* extends below the bearing where it is fixed to a crank 37 and a sprocket 38. The sprocket is driven by the main drive of the machine. The crank 37 operates the reciprocating label feed 15 as described hereinafter.

Pinch roller 33 is mounted at the ends of arms 45 fixed to a sleeve 46 which is rotatable on a shaft 47 mounted on the frame. Affixed to the sleeve 46 is an arm 48 rotatably connected at its outer end (lower end as viewed in FIG. 2) to the rod 49 of an hydraulic cylinder 50, the other end of which is rotatably mounted on a frame bracket 51. By operating the cylinder 50 in the manner described hereinafter the pinch roller 33 is pivoted into tangent contact with drive roller 32 (which is constantly rotating) and thereby grips the label stock between the two rollers and pulls it from the roll 12 at a speed proportioned to the main drive of the machine. When a pre-determined length of label stock has been pulled from the roll, pinch roller 33 is pivoted out of contact with the drive roller 32 which, although it continues to rotate, no longer pulls label stock from the roll.

The loop accumulator 34 comprises a trough-like structure 60 formed by spaced parallel vertical walls 61 and a bottom plate 62, the entry ends of the walls being tapered at 62*a* for ease of entry and exit of the label stock, which passes through the trough in the form of an open or U-shaped loop 11L and is held against the sides of the trough by roller 32 and a roller 63 rotatable on a shaft 63*a* suitably mounted on the frame. The trough 60 is mounted on two posts 65 which are slotted at 66 to receive clamping screws 67 having heads 67*a* and which pass through the slots 66 and are threaded at their inner ends into nuts 68 fixed to the walls 61 of the trough. By loosening the screws 67, the trough may be raised or lowered to a suitable position and then clamped in adjusted position by tightening the screws.

A loop sensing means is provided by light units 75, one of which emits a beam of light and the other is a photo sensor. These units and their mountings are best shown in FIG. 9. They are mounted on posts 65 for height adjustment, such mounting being the same as the mounting of the trough 60. Identical reference numerals are employed. The beam of light between these photo elements is interrupted when the loop 11L is situated between them. When the loop has been shortened so that it no longer interrupts the beam, such acts as a signal in the manner described hereinafter and causes the cylinder 50 to pivot the pinch roller 33 into contact with the label stock 11 and the drive roller 32, thereby causing resumption of feed of the label stock from the feed roll. By suitable means described hereinafter the feed of label stock into the loop 11L does not terminate at the instant the loop interrupts the beam but only after a pre-determined length of label stock has been pulled from the reel, such pre-determined length being several label lengths and such that the length of label stock in that portion of the loop extending beyond the line of sight of the light units 75 is sufficient to provide several labels of the greatest length contemplated. By means of the loop 11L the only restraint on the reciprocating label feed described below, other than friction, is the force required to pull a label length from a free loop. No force is required to pull the label stock from the roll 12.

Label stock passes around the roller 63 and a roller 76 to label guide 77. This guide comprises spaced parallel guide bars 78 which are arranged in the same vertical plane, their facing edges being formed with grooves 79 which receive and guide opposite edges of the label stock. The overall height of the bars 78 and their spacing relatively to one another is adjusted by mounting means 85 on opposite sides of the bars and spaced apart as shown. Description of one such mounting means 85 will suffice inasmuch as the other one is identical.

Referring now to FIGS. 2, 4 and 8, a post 86 is bolted to the frame and is formed with a slot 87 (see FIG. 4) through which a screw 88 passes, such screw having a head 88*a*. The screw 88 is threaded into a collar 89 which supports a screw 90 having a head 91. Brackets 92 affixed to and extending inwardly (to the right as viewed in FIG. 8) from the bars 78 are threaded to the screw 90. The screw 90 is freely rotatable in the collar 89, not being threaded thereto. The screw 90 is formed with left and right hand threads, one such being above the collar 89 and the other being below the collar. When the screw 90 is rotated in one direction by its head 91 the guide bars 78 are moved farther apart and when rotated in the opposite direction they are brought closer together. This adjustment is made to accommodate label stock of a given width. For overall height adjustment of the guide bars 78, the collar 89 or an extension of the same is moved up or down in the slot 87 in the post 86. When the bars are in the desired position the screw 88 is tightened to hold it in the desired position.

Referring now to FIGS. 3 and 5 and also to FIG. 4, the intermittent forward feed of label stock from the loop 11L through the guide bars 78 starts with the crank 37 (see FIG. 4) which has an arm 101 in one end of which at 101*a* is journaled one end of a screw 102, the other end being journaled at 103 in the arm. Screw 102 has a head 104 by which it can be rotated. A nut 105 is in threaded engagement with the screw 102 and has a threaded shaft, one end of which is free to move in a slot 106 in arm 101, the other end of the screw being rotatably connected to a link 107 which is connected to another link 108 by a connecting bar 109 formed with a longitudinal slot 110 through which screws 111 pass. The screws 111 are threaded into the links 107 and 108.

It will be apparent that the throw of the crank can be adjusted by first loosening a nut 105*a*, then rotating the head 104 of the screw 102 to move the nut 105 forwardly (to the left as viewed in FIG. 4) to increase the throw or rearwardly (to the right as viewed in FIG. 4) to diminish the throw of the crank. Then nut 105*a* is tightened to hold nut 105 in adjusted position. The link 107, 108 is adjusted by loosening screws 111 and adjusting connecting link 110, then tightening the screws 111. This adjustment is made for labels of different length and to bring the feed shoes 151 and 152 described below as close as possible at the end of their feed stroke to the shearing mechanism.

Referring now to FIGS. 3 and 5, a slide and mounting block 112 is provided which is slidable on guide rods 113, one of which is shown in full line in FIG. 5, both of which are shown in dotted lines in FIG. 3. The block 112 is formed with smooth bores 112*a* so as to slide freely on the guide rods 113. It will be apparent that by adjusting the throw of the crank 37 as described above, the travel of the block 112 and of the mechanisms supported thereby will also be adjusted according to the label length, which governs the amplitude of the intermittent label feed.

Referring to FIG. 3, a label stock gripper assembly 120 is provided for gripping the label stock when the block 112 is retracted (that is, when it is in its extreme right hand position as viewed in FIGS. 3 and 5) and for then pulling an increment of label stock (one label length) when the block 112 is moved to the left as viewed in FIGS. 3 and 5. This gripping assembly 120 comprises a first shoe 121 which is stationary except for its reciprocating movement with the block 112 and a second pivoted shoe 122 which in addition to reciprocating movement with the block 112 is mounted so that it will pivot in and out (up and down as viewed in FIG. 3) toward and away from the stationary shoe 121 and the label stock 11. Both shoes are formed of rubber or other suitable material capable of firmly gripping the label stock and holding it without slippage while avoiding damage to the label stock. The shoes 121 and 122 are carried in holders 123 and 124, respectively, the holder 123 carrying the fixed shoe 121 and the holder 124 carrying the pivoted shoe 122. The stationary shoe 121 and its holder 123 are carried by a post and its angular extension 125 mounted on the block 112. The mounting and means of pivoting the pivoted shoe 122 comprise an hydraulic cylinder 126 pivotally mounted at 126*a* on a bracket 127 which is fixed to the block 112, such cylinder having a rod 128 pivotally connected at 129 to a cross shaft 130 which is rotatable in the block 112 and various frame members and is locked in place by a ring 140 and a collar 141 having a set screw 142 to hold it in position but allow its removal. The shaft 130 is formed with a flat segment 143 to which an arm 144 is clamped by screws 145. The arm 144 carries at its outer end (the left hand end as viewed in FIG. 3) the holder 124 for the pivoted shoe 122.

In the manner described hereinafter, when the block 112 is in its fully retracted position (that is, it is to the right as viewed in FIG. 5) the shoes 121 and 122 are open by reason of the position of the rod 128 in cylinder 126, but immediately upon return of the shoes to such retracted position, the cylinder 126 is operated to pivot the shoe 122 into engagement with the label stock and the stationary shoe 121 thereby gripping the label stock between the two shoes. Then, through movement of the crank 37 and the block 112 the two shoes move forwardly (to the left as viewed in FIGS. 3 and 5) and by such means advance a segment (one label length) of the label stock, the length of such travel being determined by the throw of the crank 37 which is adjusted as described hereinabove. At the limit of its operating travel (by which is meant the forward stroke of the shoes 121 and 122 while gripping the label stock) the cylinder 126 operates to retract the pivoted shoe 122 from engagement with the label stock. This is timed to occur when a pre-determined length of label stock (one label length) has been advanced. However, the motion of the shoes 121 and 122 is caused to continue for a short distance, for example, ¼ inch in the case of a label 3 inches long. That is to say, the shoes 121 and 122 are caused to undergo a slight over travel. This is accomplished by a light sensing element described below which, when its beam coincides with a registration mark on the label stock, signals the fact that one label length has been advanced. The shoes 121 and 122 continue their forward travel as determined mechanically by the throw of crank 37, but such continued travel has no effect on the label stock.

In order to hold the label stock stationary after it has been released by the shoes 121 and 122, a brake assembly 150 is provided. This assembly comprises a stationary shoe 151 (see right hand end of FIG. 3) which is carried by holder 153 which is slidable upon a post 154 bolted to frame plate 36 (see FIG. 5) and having a slot 155 formed therein. The holder is slidable in the slot 155 and is clamped in the desired position by screws 156. Moveable shoe 152 is carried by a similar holder 155*a* fixed to one end (the lower end as viewed in FIG. 3) of an extension of 157 of the rod 158 of an hydraulic cylinder 159 which is mounted on a bracket 160. The bracket 160 has a tongue in groove connection with a frame bracket 161. When the height of the bracket 160 and cylinder 159, hence the height of the moveable shoe 152, have been adjusted as desired, they are locked in adjusted position by a screw 163. By means described hereinafter, the moveable shoe 152 is held in retracted position clear of the label stock as shown in FIG. 3 from the commencement of the forward stroke of shoes 121 and 122 but at the instant that the pivoted shoe 122 is pivoted out of clamping position as it approaches the limit of its forward travel, the cylinder 159 operates to move the moveable shoe 152 into position to clamp the label stock and hold it stationary until the start of the next forward, feed stroke of the shoes 121 and 122.

The shearing station 16 comprises (see FIGS. 3, 5, 6 and 7) a moveable shear member 170 having a cutting edge 171 and a stationary shear member 172. Moveable shear member 170 is fixed to arms 173 rotatably mounted in a collar 174 connected by an arm 175 to a collar 176 which is clamped on a flattened segment 177 of a shaft 178 which is rotatable in frame members. One end (the lower end as viewed in FIG. 5) of shaft 178 has an arm 179 which is pivotally connected at 180 (see FIG. 7) to the end of the rod 181 of hydraulic cylinder 182 pivoted at 183 on a frame bracket 184. The bracket 184 is adjustable on the frame by reason of slots 185 and screws 186. Adjustable stop members 187 are provided to limit the amplitude of movement of the arm 179, hence of the moveable shear member 170. A spring 190 attached at one end to a post 191 and at its other end to a pin 192 projecting from one of the arms 173 serves, during movement of the moveable shear member 170, to confine its movement to a single plane which is determined by abutment of an extension 170*a* (see FIG. 6) of the moveable shear member 170 to the upper portion of the stationary shear member 171. As the moveable shear member 170 moves in the direction indicated by the arrow in FIG. 6, it will shear the label stock and sever a label.

Each severed label 200 (see FIG. 3) is transferred to a vacuum label transfer drum 201. Preferably each label is gripped by vacuum on a pad 202 on the drum before it is severed. This feature is described in more detail below with reference to FIG. 10. Referring to FIGS. 10, 11, 12 and 13, drive shaft 203 driven by and in timed relation to the main drive shaft of the machine is carried in bearing 204 bolted to the frame of the machine. As explained below in connection with FIG. 20, the drive shaft 203 is provided with a clutch and a brake, neither of which is shown. When the brake is disengaged and the clutch is engaged, the shaft 203 and label drum 201 are rotated, and when the brake is engaged and the clutch is disengaged they stop. A screw 205 having a head 206 and flange 207 is threaded into the upper end of the drive shaft 203 and serves to clamp several parts together as follows: A first lower rotary member 208 having a flange 209 is provided and is formed with a central passage 210 and an upward extension 211 formed with a continuation of the passage 210. A stationary valve member 212 is seated on and in sliding contact with the upper surface of the rotary member 208 and is formed with a central passage 213 to form a sliding fit with the extension 211 and it is formed with an arcuate vacuum passage 214 which is open to the top of the rotary member 208. A collar 215 having a flange 216 is seated on the stationary member 212 and is keyed at 225, 226 to extension 211 so that the collar 215 and the rotary member 208 rotate together. A cap 227 formed with an axial passage 227*a* fits over the extension 211 and is seated on the upper end of the extension, being formed with a socket 228 for that purpose. Sockets 229 and 230 are formed in the cap 227 and the flange 217, respectively, in which a spring 231 is seated. There are several such sockets and springs, only one set being shown in FIG. 12. The screw 205 is tightened so that it holds the several parts together as shown in FIGS. 11 and 12 while allowing rotation of parts 208, 216 and 227 relatively to the stationary part 212.

Referring to FIG. 11, the member 208 is formed with an arcuate passage 240 which is connected by a flexible hose 241 to a duct 242 formed in a skirt 243, the upper end of such duct being closed by a screw 242*a*. Branch ducts 244 and 245 in the skirt 243 and the pad 202, respectively, communicate vacuum with the surface of the pad. The arcuate passages 240 (which rotates) and 214 (which is stationary) are oriented in such manner that (see FIG. 10) as a pad rotating clockwise as viewed in FIG. 10 approaches the shearing station a vacuum is applied to hold the label on the pad. The duct 214 is connected (see FIG. 10) by a fitting 246 and a tube 247 to a vacuum pump (not shown). The relative positions of the arcuate ducts 214 and 240 are such that vacuum is applied to the pad 202 from the time that a label is fed to the drum until the label reaches the labeling station, and such that vacuum is interrupted at the labeling station to release the label to a container.

There are two skirts 243 to each of which is secured a pad 202, the pads 202 being 180° apart. There may, of course, be a single skirt and pad and there may be more than two skirts and pads. Since the construction of each skirt and pad and associated parts are the same, description of one such assembly will suffice.

Referring to FIGS. 10 and 12, a post 260 is provided which is mounted in an opening 261 in the flange 209 of member 208 and is clamped in place by a screw 262 and collars or rings 263 and 264. Rotatably mounted on the post 260 by bushings 265 is a sleeve 266 which is integral with an inner skirt 266 having a horizontal flange 267 (see FIG. 11) to the under surface of which is secured the outer skirt 243 by means of a screw 268. The two skirts 243 and 266 are arcuate and they overlap, the arcs being sectors of circles which are coaxial to the drive shaft 203. The skirt 266 is formed with a lever arm 270 (see FIG. 10) whose end remote from the sleeve is acted upon by a spring 271 which is seated in a socket 272 in the lever and a socket 273 in the flange 208 (see also FIG. 13). As will be apparent, the spring 271 urges the skirts 243 and 266, and with them the pad 202, inwardly toward the drive shaft 203 and therefore tends to hold the pad out of contact with a glue wheel 274 which applies glue to the exposed surface of the label 200, such surface being that which is applied to the container surface. The skirts 266 and 243 are, however, normally held in their outer operating positions so as to contact the label 200 with the glue wheel. This is accomplished by means shown in FIG. 11. A plate 280 is secured to the inner surface of the skirt 243 by screws 281 and it has an edge 282 projecting below the skirt 243 so as to contact the tip 284 of a latch 285 pivoted on member 208 at 290. The latch 285 is held in its normal latching position shown in FIG. 11 by a spring 291 connected as shown to the latch 285 and to a pin 292 carried by the member 208. Therefore, during normal operation each label 200 on a pad 202 will be contacted during each revolution of the shaft 203 by the glue wheel 274. However, if a label is missing, such condition is sensed by means described below and the resulting signal actuates a hydraulic cylinder 300 (see FIG. 10) mounted on a frame bracket 301 and having a rod 302 and a rod extension 303. To the end of rod extension 303 is attached a cam block 304 having a cam surface 305. Operation of cylinder 300 to extend rod 303 and cam block 304 causes the latter to pivot latch 285 counterclockwise as viewed in FIG. 11. The release of latch 285 allows spring 271 (see FIG. 10) to pivot skirts 266 and 243 and pad 202 counterclockwise as viewed in FIG. 10. Therefore, the pad and the label on the pad pass by the glue wheel 274 without contacting it. Such contact would apply glue directly to the pad and foul it so that the next label applied to the pad will be smeared on that side which is exposed after it has been applied to a container and it will also foul holes in the pad through which vacuum is applied to the label.

When the pad in question, which has been pivoted out of contact with the glue wheel, has rotated past the labeling station and back toward its starting position, a cam 310 (see FIG. 10) bolted to a frame member and having a rise 311, a high point 312 and a decline 313 acts against a cam follower roller 314 (see FIG. 10) mounted on the flange of the inner skirt 266 and pivots the skirts 243 and 266 and the pad 202 clockwise as viewed in FIG. 10. If a label is applied to the pad (which is normally the case), the cam block 304 will be retracted and the plate 280 will be riding on the upper surface of the latch 285. As the plate 280 is pivoted outwardly by cam 310, it will clear the latch 285 which will then pivot clockwise as viewed in FIG. 11. As the plate rides down the decline 313 of the cam 310, the plate 280 will be moved back inwardly by the force of the spring 271 but will be stopped from further inward movement by latch 285. The pad 202 will, therefore, resume its operative position to contact the label 200 carried by it with the glue wheel 274.

Referring now to FIGS. 14 to 17, a glue assembly 320 including the glue wheel 274 is provided, the glue wheel being provided with a protective housing 274*a* (see FIG. 15). This entire assembly is mounted on a frame plate and is driven by a shaft 321 which in turn is driven by the main drive of the machine and at a speed proportional to the speed of such main drive. The assembly includes a glue pot 322 having a massive bottom 323 enclosing electric heating elements 323*a* and having fins 324 to dissipate heat into the body of hot melt glue. A gasket 325 provides a seal against the frame plate on which the assembly is mounted. The frame plate is formed with an opening 326 into which a removable cover 330 fits which has a double top 327, 328 separated by spacers 329 to form an insulating air space whereby the cover may be lifted by its handle 331 without burning the hand of an operator. A glue pump is provided in the form of a gear pump 345 driven by a shaft 346 in a tube 347. The shaft 346 is driven by means described below by the drive shaft 321. The gear pump 345 may be any conventional gear pump of suitable size in a housing 348 and having an inlet 349 and outlet 349*a*. Above the gear pump is an annular passage 351 between tube 347 and shaft 346 which provides a duct for the glue as it is pumped from the glue pot. Shaft 346 is rotatable in a bushing 354 and is keyed to a gear 355 which is driven by a gear 356 fixed to the glue wheel 274, thus providing a common drive for the glue wheel 274 and the glue pump 345, such common drive in turn being driven by the shaft 321, hence by the main drive of the machine and at speeds proportional thereto. The uppermost end of shaft 346 is rotatable in a bushing 365 in a cover plate 366 which is bolted as shown at 367 to a flange 347*a* integral with the housing 347 of shaft 346. A collar 370*a* secured by a set screw 370 secures the shaft 347 to the cover but allows its removal when desired.

Referring to FIG. 15, a duct 371 connects the interior of the upper end of the gear pump with a duct 372 formed by plates 373 which are bolted together. The duct 372 has a slanting outlet 374 approximately parallel to the periphery of the glue wheel 274. A doctor blade 375 is fastened to one of the plates 373 by means of a plate 379 and screws 380 (see FIGS. 16 and 17). Before the plate 379 is tightened, screws 381 are manipulated to locate the outer edge of the doctor blade close to the surface of the glue wheel. The vertical length of the doctor blade, as shown in FIG. 16, is such as to cover the entire area of the glue wheel to which glue is to be applied.

It will be apparent that the glue, which is kept melted in the glue pot 322, will be continuously applied to the desired area of the cylindrical surface of the glue wheel, being evenly applied by the doctor blade 375. The proper rate of supply of glue, which will vary according to conditions such as, for example, the nature of the glue and/or the nature of the containers to which the labels are applied and/or the nature and size of the labels and perhaps other factors, can be controlled without changing the speed of the gear pump (which operates at a speed proportional to the speed of the machine). This is done by means shown in FIG. 15. A return duct 390 formed in one of the plates 373 and a connecting return tube 391 returns a portion of the glue to the glue pot by way of the return tube 391 without reaching the glue wheel 274. Two set screws 392 and 393 are provided, one of which (392) extends into the duct 372, the other (393) extending into the duct 391. These set screws are manipulated so that the proper amount of glue is delivered to the glue wheel, for example, enough to coat the surface of a label adequately without there being a large excess.

The allowable excess glue is returned to the glue pot 322 by dripping into an annular channel 394 (see FIG. 14) formed in a casting 395 and then flowing through an opening 396 into return duct 391.

As mentioned above, the drive shaft 321 drives the glue wheel 274 and also the glue pump 345. Shaft 321 is carried in a bearing 400 and above the frame plate it has a head 401 on which the flanged bottom 402 of the glue wheel 274 sits. A screw 403 secures the glue wheel to the upper end of the shaft 321. An outer, annular groove 404 in the bottom of glue wheel 274 fits over circular flange 405, which, together with the outer flange 406 of casting 395 form the well mentioned above for reception of glue dripping from the glue wheel 274.

The screw 403 has an upward smooth extension which extends into a socket 407 in the bottom of a cylindrical electric heater 410 which is held at the top by a screw 411 passing through the cover plate 366. The fit of the heater on the screw 403 is loose enough that the heater, which is stationary, does not interfere with rotation of the glue wheel 274 yet it is tight enough to prevent undue vibration.

Referring now to FIG. 18, one type of container 420 (cylindrical) and one type of container feed 421 (a star wheel) are shown during application of a label by the vacuum drum. The star wheel 421 is of known construction and is rotated intermittently by a drive shaft 423 to which the body 424 of the star wheel 421 is secured by a screw 425. The shaft 423 is provided with a brake and a clutch (not shown). The clutch is driven by the main drive of the machine. When the brake is engaged and the clutch is disengaged, the star wheel is at rest and when the brake is disengaged and the clutch is engaged, the star wheel is rotated. The body 424 has flanges 426 to which plates 428 are bolted to form pockets, for example, the four pockets 429 shown in FIG. 1, each of a size and shape to cradle a container as shown in FIGS. 1 and 18. These plates are change parts and may be replaced whenever a container is run through the machine whose size requires a change. The containers are supported upon a plate 429*a;* they are supplied by any suitable container feed such as a helical screw or by gravity; and they are picked up one by one by the pockets of the star wheel which indexes each container to the proper position at the labeling station. The container is held at that position between a resilient pad 430 on the body of the star wheel and the pad 202 on the vacuum drum. The pads 430 are freely rotatable on the body of the star wheel, for example, by means including bushings 432 and sleeve 433. The pad 430 is affixed to the sleeve 433.

In operation a container 420 is indexed to the position shown in FIG. 18 and held stationary at such position (except that it is free to rotate about its own axis) while a pad 202 on the label vacuum drum rotates past it. The vacuum that holds the label on the pad is released to release the label to the container. The container is caused to spin about its cylindrical axis by reason of being clamped between the two pads and rotation of the pad 202 about the axis of drive shaft 203. The label is therefore wrapped around the container. Then the star wheel 421 starts again to remove the labeled container and to index into position the next, unlabeled container. If only a partial label is applied which is not wrapped completely around the containers, the operation may be modified accordingly.

Another type of container feed is shown in FIG. 19 which is intended for containers which are not cylindrical in shape. This feed comprises a star wheel 441 rotating with the drive shaft 442. The star wheel 441 has pockets 443 adapted to receive and cradle containers 444 having flat sides 445. These containers are passed through the labeling station by a container conveyor 446 of known construction. As each container is indexed to the labeling station, a label is applied. Since the label is not wrapped around the container, it is advantageous to provide roll on rollers 427 and 428 downstream which insure even application of the label to the container. These have resilient covers and are freely rotating.

Referring to FIGS. 21 and 22, the star wheel 421 is shown having pockets 429 into which the pad 430 on the star wheel project. The label drum is shown as having pads 202 which are provided with leading ramps 442 at the leading end and with trailing ramps 442*a* at the trailing end. These ramps may be made of the same material as the pad 202 and in fact they may be molded integrally with the pad 202. The leading ramp 442 has an inclined portion slanting upwardly and to the left as viewed in FIG. 22 from the level of the label drum and it then levels off at 443 and terminates at the leading end of the pad 202 and slightly below the outer surface of the pad 202, typically about 1/32 inch below. The trailing ramp 442*a* has the same shape but in reverse.

As a container is indexed to the labeling station and brought to rest, it is first pushed outwardly by the star wheel pad 429 but then the leading ramp 442 exerts an increasing radial pressure on the container forcing it radially inwardly with respect to the star wheel and in so doing it compresses star wheel pad 429. At the same time, by reason of its confinement between the leading ramp 442 (then the pad 202) and the star wheel pad 429, the container is caused to spin about its own axis and to wrap the label around itself. The gradual increase of pressure applied by the leading ramp 442 is helpful in forming a good application of the label, and the tapering off of such pressure by the trailing ramp 442*a* is helpful in that it avoids a sudden release of pressure and ensures a good seal at the trailing end of the label. Further, the overhang of the label at both ends, as described above, protects the ramp from leakage of glue. If glue should be spilled on these ramps, it is not applied to the inner surface of the next label, which becomes the outer, exposed surface of the label when it is applied to a container.

It will be apparent from the description above and from the drawings that the machine comprises several subassemblies which undergo cycles of operation or which operate continuously and that the machine has an overall cycle of operation. Thus the pre-feed operates intermittently while the drive roller 32 and the glue wheel 274 operate continuously. At intervals, governed by the overall speed of the machine and by the position of the loop 11L, the pinch roller 33 is pivoted into engagement with the label stock and the drive roller 32 to restore the loop 11L to its intended maximum length and will then retract out of engagement with the drive roller. Since there may be slippage of the label stock between the rollers 32 and 33, the size of loop 11L may not be exact but its inexactness offers no disadvantage.

The reciprocating feed 15 operates continuously, its stroke being determined by the throw of the crank 37 and its frequency being determined by the overall speed of the machine. Assuming as a starting position for the cycle, the brake shoes 151 and 152 will be in engagement with the label stock holding it in fixed position and the feed shoes 121 and 122 will be disengaged and at their rearmost position ready for the commencement of a feed stroke. Then the brake shoes 151 and 152 are disengaged from the label stock, the feed shoes 121 and 122 are engaged and the label stock is fed forwardly. As described above, just before reaching the limit of their forward stroke, the feed shoes 121 and 122 disengage the label stock and the brake shoes 151 and 152 reengage the label stock which therefore is brought to a halt, having been fed forwardly by one label length. Also as described above, the feed shoes 121 and 122 continue their forward stroke to its limit and then return to the starting position for the start of the next cycle.

The shear 170 operates intermittently acting to shear or sever a label of a length corresponding to the forward feed part of the stroke of the label stock. This is preferably timed to occur at the instant that the feed shoes disengage, the brake shoes engage and the label stock comes to rest.

The label drum 17 operates in intermittent, stepwise manner. Inasmuch as there are two pads 202, it will rotate at each step by 180°. (If there is a single pad it would, of course, rotate 360° and if more than two pads are employed the arc through which it would rotate would vary accordingly.) During each 180° cycle of motion the label drum will transport a label past the glue station for application of glue and through the labeling station for application of a label to a container and for wrapping it around a container. Meanwhile the other pad will be rotating past the shear and will pick up the next label.

The star wheel will operate by an indexing movement. Assuming that four pockets are employed as shown in FIG. 1 during each step the turret or star wheel will index 90°. If a greater or lesser number of pockets are employed, the arc of rotation will vary accordingly.

A preferred overall cycle is as follows: Referring to FIG. 23, shear member 170 has just severed a label and has retracted; the brake shoes 151 and 152 are engaged; and the feed shoes 121 and 122 are disengaged and are at or very close to their limit of forward travel. The trailing end of pad 202 has just passed the shear and the now severed label is almost completely on the pad. Preferably the label drum is operated at a speed such that the linear speed of the surface of the pad 202 is slightly greater than the linear speed of the label stock whereby the label stock will be caused to slip on the outer surface of the pad. The length of the label in relation to the length of the pad and the timing are such that when a label has been completely deposited on the pad its leading end will project slightly beyond the leading end of the pad and its trailing end will project slightly to the rear of the trailing end of the pad. This provides a protection against glue which might leak over on to the pad.

At this instant, with a label on the pad and located between the shearing station and the glue station (and with the other pad having rotated past the labeling station) the label drum comes to a halt. At this instant the star wheel 421 will index so that the next container is moved to the labeling station, the preceding labeled container having been removed from that station. Then rotation of the label drum recommences, the label that has just been applies to the pad is moved past the glue wheel, the glue wheel applies glue to the label and the label is then moved to and through the labeling station, resulting in application of the label to a container. Then the label drum comes to a halt and a new cycle is commenced.

It will be apparent that any of a great variety of mechanical, electrical, electro-mechanical and electronic controls are commercially available, are well known and may be employed to carry out the above overall cycle of operation or such other cycles as may be desired. A suitable and preferred control assembly and circuit are partially shown in FIG. 20.

The label drum shaft 203 is provided with a brake and a clutch (not shown), the clutch being disengaged when the brake is engaged and vice versa. When a container at the sensing position SP (see FIG. 1) is sensed by an optical sensor (not shown) a signal is applied to a relay 500 through a timing switch 501 which is preferably a camless limit switch 501. This switch is adjusted to operate relay 500 to disengage the brake and engage the clutch, causing rotation of the label drum. Such rotation continues until it is stopped by means now to be described. There is shown a disc 503 fixed to a shaft 504 and formed with two holes 505. The two holes are shown 180° apart by reason of the fact that there are two pads on the label drum. A fewer or a greater number of holes and their angular spacing will depend, of course, upon the number of pads on the label drum. Also shown are two optical elements 506. Rotation of the drum is continued until the other hole 505 is brought into registry with the line of sight of the optical elements 506 at which time the relay 500 is actuated to act upon an operator 502 to disengage the clutch and engage the brake, thereby bringing the label drum to a halt.

Shortly thereafter, the label feed is commenced. A switch 507 operated from the drive shaft of the label drum closes and thereby actuates a relay 508 but under the control of a container sensor (not shown, and which may be the same as the container sensor mentioned above) and a camless limit switch 501*a*, which may be another channel in switch 501. When the relay 508 is actuated it operates to release the brake shoes 151, 152 and to engage the feed shoes 121 and 122, thereby initiating a forward feed of the label stock. This cannot occur unless the above mentioned container sensor senses the presence of a container at the sensing position SP.

When a registration mark on the label stock is sighted by a photoelectric sensor (not shown), relay 508 is actuated to open the feed shoes 121 and 122 and to engage the brake shoes 151 and 152. If for any reason the feed shoes fail to open, a camless switch 516 functions to so actuate the relay 508 and to engage the brake shoes and disengage the feed shoes. A star wheel control relay 520 is provided which actuates operating mechanism 521 to engage or disengage the brake (not shown) and to disengage or engage the clutch (not shown) of the star wheel. This relay is actuated in the following manner: A photoelectric sensor (not shown) senses the presence of a label on the pad of the stationary label drum between the shearing station and the glue station. A photoelectric sensor (not shown) senses the presence of a container at sensing position SP. When both of these conditions prevail, that is to say a label is on the pad of the label drum between the shearing station and the glue station and a container is at the sensing position, then the relay 520 is actuated to disengage the brake and engage the clutch of the star wheel. The timing of such actuation is determined by adjustment of camless switch 524. This starts the star wheel to index. A disc 530 is provided affixed to a shaft 531 which rotates with the shaft of the star wheel and which has holes 533 (as many as there are pockets in the star wheel). Photoelectric elements 535 are provided and when the disc rotates so that the next hole is in the line of sight between these photoelectric elements, the relay 520 is actuated to engage the brake and disengage the clutch, thus bringing the star wheel to halt with an unlabeled container at the labeling station.

The cylinder 300 which operates the cam block 305 (see FIGS. 10 and 11) is operated in the following manner: When a photoelectric sensor (not shown) senses that there is no label on the pad, it actuates a relay 541 which in turn causes operation of the cylinder. An element 542 coupled to the drive shaft of the label drum interrupts this circuit, i.e. prevents photo sensor from actuating relay 541, if the label drum is in motion. Camless limit switch 543 is adjusted to time the actuation of the relay by the photoelectric sensor.

The cylinder 182 which operates the shear member 170 (see FIG. 7) is operated by the same signal that causes the vacuum drum to stop, i.e. alignment of a hole 505 with the photo elements 506.

The cylinder 50 which pivots the pinch roller 33 is controlled by a relay 550 which actuates an operator 551. Thus when the photo sensors 75 sense that the loop 11L has been shortened so as no longer to be in their line of sight, they actuate the relay 550 and through it the operator 551 to operate the cylinder to pivot the pinch roller into engagement with the label stock and the drive roller. This is timed by a timer (not shown) in the circuit of photo sensors 75 to occur later, such time delay allowing a sufficient length of label stock to accumulate beyond the line of sight to produce several labels.

The controls will include suitable valving means such as, for example, electrically operated valves, a hydraulic pump or pumps and suitable connections from the valves to the various cylinders. Such components of the control system are well known and require no description herein.

Operation with a star wheel and containers which are not round, as shown in FIG. 19, is the same except that the containers are not rotated during label application.

The machine has been described in connection with pre-printed labels severed from continuous label stock. A printer may be incorporated in the label feed to print blank label stock, and a printer may also be incorporated to print pre-printed label stock with code identification. If the labels are what is known as "shaped labels", i.e. labels which are, for example oval or diamond shaped, the cutter 170, 172 may be replaced by a rotary die cutter such as, for example, that described in Dickey U.S. patent application, Ser. No. 871,554, filed Jan. 23, 1978, entitled "ROTARY DIE CUTTING ASSEMBLY FOR CUTTING LABELS" now U.S. Pat. No. 4,188,843. Cutters such as shown in my patents above mentioned may be used in place of a reciprocating cutter. Label stock which has a heat softenable adhesive on its back (the face exposed on the label drum) may be used in which case the glue assembly will be replaced by a source of hot air to soften the adhesive. Also the label stock may have a pressure sensitive adhesive on it, in which case suitable means (well known) to peel the masking tape would be used and the glue assembly would be dispensed with. Also in such cases the label drum need not have a pivoted mounting for the pads. It will also be apparent that the pre-feed and reciprocating feed may be employed generally for feeding continuous strip or sheet material. Further, the machine without the pre-feed and reciprocating feed may be used with pre-cut labels with a suitable feed for such labels.

A number of important advantages of the machine described and illustrated above will be apparent, among which are the following: The drive roll 32 for the label stock and the label feed drum 201 are operated continuously notwithstanding intermittent feed of the label by the shoes 121 and 122. Contributing to this feature is the storage of label stock in the trough 34. The over travel of the loop 11L avoids frequent starting up and stopping supply of label stock to the trough 34. The storage of several lengths of label stock in the trough allows rapid feed of the label stock to the shear without requiring the feed shoes 121 and 122 to pull label stock directly off of the reel. Instead, the shoes withdraw label stock from a loop which offers very little resistance. The brake shoes hold the label stock firmly while the feed shoes are disengaged. This contributes to accuracy of label feed and cutting.

As described above, the pads 202 are automatically retracted whenever a label or a container is missing and are then restored to operating position when this condition is eliminated. This is advantageous because it requires no change in the glue assembly. Most glue assemblies used at the present time are separately purchased pieces of equipment which are expensive to purchase and expensive to install and to time with the labeling machine. By contrast the glue assembly of the present invention is simple to install, much of it is beneath the frame plate 36 and out of the way, and it operates at a rate proportional to the rate of label feed, both as regards speed of the gear pump and speed of the glue wheel.

There are many adjustment features, e.g. for the stroke of feed shoes 121 and 122, which is determined by the label length; for the height and spacing of guide bars 78, which are determined by the label width, etc. The supply of glue to the glue wheel can be adjusted with precision by the set screws 392 and 393. The glue pump and heater can be removed and by unscrewing the glue wheel it can be removed. The rate of glue application, which is determined by the speed of the glue pump, the speed of the glue wheel and the setting of screws 392 and 393, is proportional to the overall speed of the machine. Therefore, glue is automatically supplied at a rate proportional to the rate at which labels are applied to containers. The apparatus as a whole and its component parts whether used in the complete combination shown or used in combination with other components provide the above and other advantages.

It will, therefore, be apparent that new, useful and advantageous labeling apparatus has been provided. As noted above, the apparatus may be used to sever segments of uniform length from a continuous sheet or web or paper, plastic, metal, foil, textile material, etc. and to apply it to a variety of objects and articles.

I claim:

1. Apparatus for severing segments of sheet or film like material from a continuous length of the same and for applying such severed segments to articles, said apparatus comprising:

(a) a pre-feed including a continuously operating drive roller and a pinch roller, said rollers being parallel and one of them being mounted for movement into and out of engagement with the other roller for pulling such material from a roll of the same when they are in engagement and for terminating such pulling when they are disengaged (b) storage means for storing in loose condition a quantity of such material as delivered by said pre-feed (c) a reciprocating feed having a feed stroke and a return stroke and operable during each feed stroke to grip, withdraw from such storage means and feed forwardly a predetermined length of such material (d) a severing means operable to sever segments of material of predetermined length as fed to it by said reciprocating feed during each forward stroke thereof (e) transfer means operable to pick up each severed segment and transfer it to an application station (f) an article feed operable to supply articles in succession to said application station, said article feed and transfer means being operable to apply a segment to each such article and (g) control means acting to engage and disengage said rollers, said control means including a scanner which senses when the quantity of material in storage reaches a predetermined length, said control means including in addition to the scanner mechanical means actuated by the scanner to disengage the rollers when such condition is sensed and to re-engage the rollers thereafter when the length of stored material has diminished.

2. The apparatus of claim 1 wherein the storage means acts to store the sheet material in the form of an open loop.

3. The apparatus of claim 2 including sensing means so located that a beam of light generated by such sensing means is interrupted by the loop when the length of stored sheet material reaches a predetermined length, said apparatus also including operating means acting to pivot the pinch roller into engagement with the drive roller when the light beam is uninterrupted and to pivot the pinch roller out of such engagement after the beam has been interrupted.

4. The apparatus of claim 3 wherein said control means includes a delay element which causes a predetermined length of sheet material to be supplied to the storage means after such light beam has been interrupted.

5. The apparatus of claim 1 wherein said reciprocating feed comprises:

(a) a guide for guiding said sheet material as it is withdrawn from storage along a path to the proximity of said severing means, said guide acting to support the material by opposite side edges and to leave the intermediate and major portion thereof unsupported (b) a pair of feed shoes located on opposite sides of said path and located to contact the intermediate portion of the sheet material and grip it from opposite faces for movement thereof with the shoes (c) means for moving said feed shoes together between a starting point and the proximity of said severing means and means also mounting at least one of said feed shoes for movement to and away from said sheet material for gripping the material and releasing it and (d) means operable to perform a repetitive cycle wherein said feed shoes are brought together at a starting point to grip said sheet material, then move it forwardly to the proximity of said cutting means, then release the sheet material and then return to their starting point.

6. The apparatus of claim 5 wherein said guide means is in the form of a pair of spaced, parallel guide bars lying in the same plane and formed with grooves along their facing edges to receive and guide the sheet material.

7. The apparatus of claim 6 including adjustment means for adjusting the spacing and height of said guide bars.

8. The apparatus of claim 5 also including brake means comprising:

(1) a pair of brake shoes located on opposite sides of said path, said brake shoes occupying a fixed point along the path of movement of the sheet material and at least one of them being moveable toward and away from the other to grip and then release the sheet material and (2) means operable to perform a repetitive cycle wherein when the feed shoes release the sheet material in the proximity of the cutting means, the brake shoes are brought into engagement to grip and hold the sheet material and continue to do so until the feed shoes have started their next cycle and the brake shoes are then released.

9. The apparatus of claim 8 including means acting to cause the feed shoes to open and release the sheet material when a predetermined segment thereof has been fed forwardly and to cause the feed shoes to continue their forward movement after such release for a predetermined distance.

10. The apparatus of claim 1 wherein the transfer means is in the form of a rotary vacuum drum located between the severing means and the application station and situated to receive segments as they are severed by the severing means at a segment receiving station, said drum acting to hold each severed segment on its cylindrical surface by vacuum and to release it at the application station, said apparatus also comprising:

(1) a glue assembly including a constantly rotating glue applicator rotating about an axis parallel to that of the drum and situated so as to cause the glue applicator to contact the exposed surface of each segment as it passes by and thereby apply glue to it, said glue applicator occupying a fixed position (2) at least one peripheral sector on said drum acting to receive segments from the severing means at the segment receiving station and mounted for arcuate movement about an axis parallel to and between the drum and glue applicator axes, said arcuate movement being between a first operating position to contact the glue applicator and a second retracted position separated from the glue applicator and (3) means operable to retract such sector upon command and thereafter to return the sector to its first, operating position and to hold it in such operating position rigidly and positively.

11. The apparatus of claim 10 wherein said sector is in the form of an arcuate arm coaxial to the drum and pivotally mounted for movement between said first position and said second position, said apparatus also including means normally biasing such sector toward its second, retracted position, latch means acting normally to hold the sector in its first position, unlatching means operating to release said latch upon command and cam means operable thereafter to restore the arm to its first position.

12. A reciprocating feed for continuous strip or sheet of material from a source thereof comprising:

(a) a rotary pre-feed including a continuously rotating drive roller, a pinch roller moveable into engagement with the drive roller for continuous forward feed of the material and out of engagement with the drive roller for interruption of such continuous feed (b) a reciprocating feed which undergoes a cycle in which a reciprocating feed member grips the material at a starting point, moves the material forwardly a pre-determined length and then returns to the starting position (c) a storage unit located between the pre-feed (a) and the reciprocating feed (b) and adapted to store in loose condition a length of such material fed to it by the pre-feed (a) and to be withdrawn from it by the reciprocating feed (b) and (d) control means acting to move said pinch roller into and out of engagement with said drive roller, said control means including a scanner which senses when the length of material in the storage unit reaches a predetermined amount, said control means including in addition to the scanner mechanical means actuated by the scanner to disengage the pinch roller from the drive roller when such condition occurs and to re-engage the pinch roller with the drive roller thereafter when the length of stored material has diminished.

13. The improvement of claim 12 wherein said control means operates in such manner that the pinch roller is disengaged from the drive roller when the length of material stored in storage unit (c) is at least equal to a multiple of the predetermined length fed by reciprocating feed (b).

14. A vacuum pad for transport of segments of flexible sheet material between a segment receiving station and a segment delivery station comprising a rotary member rotatable about a fixed axis, a sector carried by said rotary member and mounted for arcuate movement about an axis parallel to said fixed axis between a first outer position to effect contact between the exposed surface of a segment carried by the sector and a glue applicator and a second inner position retracted from such contact, and means operable to retract such sector upon command to its second position and to return it to its first position, said means including spring means acting to move the sector to its second position and positive means including a latch acting to move the sector to its first position and to hold it positively and rigidly in such position.

15. The apparatus of claim 14 wherein said sector is in the form of a pivoted arm capable of pivoting between said first and second positions and which carries a resilient pad on its peripheral surface, such pad being adapted to receive and support a segment of flexible sheet material, said apparatus also being provided with vaccum means for applying a vacuum to such peripheral surface to hold the segments thereon and to release them at an application station.

16. The apparatus of claim 15 including spring means acting to urge the arm to its second position, latch means normally acting to restrain such spring means and to hold the arm in its first position, unlatching means operable upon command to release the latch and allow movement of the arm to its first position and resetting means operable to restore the arm to its first position.

17. A label transfer and glue applicator apparatus comprising:

(a) a rotary vacuum drum having at least one peripheral sector having a surface adapted to pick up labels at a label receiving station and rotate the labels to a label applying station; said drum including vacuum means operable to hold such labels on such surface by vaccum between said stations and to release them at said label applying station, said sector being mounted for arcuate movement of such surface about an axis parallel to the drum axis outwardly to a first position more remote from the rotary axis of the drum into operative engagement with the glue applicator and inwardly to a second position closer to the rotary axis and out of such contact, (b) a glue assembly including a rotatable glue applicator rotating about a fixed axis parallel to the rotary axis of said drum and operable when said sector is in its first position to apply glue to the exposed surface of labels carried thereby, said glue applicator being mounted between said stations (c) means operating automatically whenever a label is missing on said surface to move the sector to its second position and (d) means for returning said sector to said first position and maintaining it in such position when a label is affixed to said surface, said means including a latch which acts to hold the surface in such position positively and rigidly.

18. The apparatus of claim 17 wherein said sector is spring loaded to urge it toward its second position, said apparatus including also a latch which normally latches the pivoted sector in its first position, and said return means is in the form of a stationary cam and a cam follower mounted for rotation with said sector, said cam follower upon contact with said cam urging the sector from its second position to its first position and allowing said latch means to latch the sector in its first position.

19. Label transfer apparatus for picking up labels or the like at the label receiving station and transporting them to a label applying station, said apparatus including at least one resilient pad presenting a cylindrical label receiving surface rotating about a fixed axis from said receiving station to said labeling station and back to the receiving station, said pad having at its leading end a tapered extension slanting radially inwardly so as to exert a gradually increasing pressure on a container held at the label applying station, the radially outermost surface of such extension terminating slightly below the radially outermost surface of the pad.

20. The transfer apparatus of claim 19 including also a similar tapered extension at the trailing end of the pad.

21. The apparatus of claim 20 including vacuum means acting to hold a label on to the pad as delivered to it at the labeling receiving station, to hold the label on the pad during transport and to release the label at the label applying station.

22. A star wheel-label feed assembly comprising:

(a) a label feed drum rotating about a fixed axis and having at least one arcuate, peripheral compressible pad concentric to said axis and adapted to receive labels in sequence at a label receiving station, to transport each lable to label applying station, to release the label at the label applying station and then to return to the label receiving station, (b) a star wheel article feed mounted for rotation with a shaft parallel to the axis of the label drum and having one or more pockets each capable of holding a cylindrical container with its axis parallel to the axis of the label drum and capable of indexing movement to bring each container in turn to the label applying station with the container confined by such pocket and a pad on the label drum and (c) a resilient pad mounted on and freely rotatable on the shaft of the star wheel and acting when a container is confined between a pocket of the star wheel and a pad on the label drum to exert a pressure on the container and to cause the container to spin about its individual axis while the star wheel remains stationary at the label applying station and while the pad on the label drum rotates past the label applying station.

* * * * *